US009598896B1

(12) United States Patent
Pichik

(10) Patent No.: US 9,598,896 B1
(45) Date of Patent: Mar. 21, 2017

(54) RETRACTABLE BARRIER ASSEMBLY

(71) Applicant: Marc D Pichik, Dubuque, IA (US)

(72) Inventor: Marc D Pichik, Dubuque, IA (US)

( * ) Notice: Subject to any disclaimer, the term of this patent is extended or adjusted under 35 U.S.C. 154(b) by 0 days.

(21) Appl. No.: 14/862,542

(22) Filed: Sep. 23, 2015

(51) Int. Cl.

| | |
|---|---|
| ***E06B 9/40*** | (2006.01) |
| ***E06B 9/08*** | (2006.01) |
| ***E06B 9/56*** | (2006.01) |
| ***E06B 9/78*** | (2006.01) |
| ***E06B 9/60*** | (2006.01) |
| ***E06B 9/80*** | (2006.01) |
| *E06B 9/00* | (2006.01) |

(52) U.S. Cl.
CPC ..... *E06B 9/08* (2013.01); *E06B 9/56* (2013.01); *E06B 9/60* (2013.01); *E06B 9/78* (2013.01); *E06B 9/80* (2013.01); *E06B 2009/002* (2013.01); *E06B 2009/802* (2013.01)

(58) Field of Classification Search
CPC ..... E06B 2009/002; B60R 5/047
USPC ..... 160/24, 99, 100, 28, 120, 241, 302
See application file for complete search history.

(56) References Cited

U.S. PATENT DOCUMENTS 193,573 A * 7/1877 Tripp ..... A47G 5/02 16/429
1,718,234 A * 6/1929 Hickey ..... E06B 9/54 160/120
1,738,608 A * 12/1929 Perior ..... E06B 9/54 160/28
2,870,831 A * 1/1959 Peselnick ..... E06B 9/24 160/113
3,187,761 A * 6/1965 De Maio ..... E04H 15/003 135/118
4,124,196 A * 11/1978 Hipskind ..... E01F 13/028 116/63 P
4,156,449 A * 5/1979 Petersen ..... A47F 10/06 160/120
5,660,144 A * 8/1997 Venti ..... A01K 1/035 119/416
6,089,302 A * 7/2000 Britt ..... E06B 9/08 160/28
6,435,250 B1 * 8/2002 Pichik ..... E06B 9/02 160/24
6,733,204 B1 * 5/2004 Paniccia ..... E01F 7/06 160/238
6,779,537 B1 * 8/2004 Miller ..... A01M 31/00 135/117
6,807,999 B1 * 10/2004 Bowen ..... E01F 13/028 160/24
7,082,981 B2 * 8/2006 Perez, Jr. ..... A01K 1/035 160/24

(Continued)

*Primary Examiner* — David Purol
(74) *Attorney, Agent, or Firm* — Steven H. Greenfield; Greenfield Invention and Patent Consulting Inc.

(57) ABSTRACT

Embodiments for barrier assemblies and setup configuration of these barrier assemblies are disclosed. The barriers are used to block the entry of children or animal into areas in which their safety may be jeopardized. The barrier assemblies contain a sheet configured for outstretching and for retraction into a roll form, and for being maintained under tension in an outstretched form. A locking assembly prevents the sheet from accidentally retracting. The barrier assemblies are configured for indoor use by means of attaching to walls and stair posts as well as for outdoor use by anchoring the barrier assembly to the ground.

23 Claims, 28 Drawing Sheets

(56) References Cited

U.S. PATENT DOCUMENTS

| | | | | |
|---|---|---|---|---|
| 7,377,490 | B1 * | 5/2008 | Khosravian | E01F 13/028 119/416 |
| 7,438,112 | B2 * | 10/2008 | Cheng | E01F 13/028 160/24 |
| 8,191,604 | B2 * | 6/2012 | Wang | E06B 9/0692 160/23.1 |
| 8,881,787 | B2 * | 11/2014 | Wang | E06B 9/60 160/24 |
| 2005/0098770 | A1 * | 5/2005 | Schell | E01F 13/028 256/25 |
| 2007/0228349 | A1 * | 10/2007 | Smith | E01F 13/028 256/12.5 |

* cited by examiner

RETRACTABLE BARRIER ASSEMBLY

FIELD OF THE INVENTION

The present invention relates to embodiments of a barrier assembly for indoor and outdoor uses and embodiments for setting up and utilizing the barrier assembly.

BACKGROUND OF THE INVENTION

Barriers have many uses. For example, a barrier may be used to restrict a child to an outdoor play area, to prevent a child from falling off the stairs or to restrict a dog from running out to the street. Barriers are also used to warn the public and limit access to crime scenes, to construction areas and in directing traffic. For many of these applications, it would be desirable to construct the barriers in a way that allows quick assembly, quick setup and quick disassembly rather than constructing more permanent barriers that tend to be pricey to erect and remove, such as fences.

SUMMARY OF THE PRESENT INVENTION

It is an object of the present invention to provide barriers configured for protecting children, animals, as well as grown-ups. It is further the object of the present invention to provide barriers that fit in both indoor and outdoor environments. It is also the object of the present invention to make the barriers easy to assemble, set up and disassemble. It is additionally the object of the present invention to provide barrier construction assemblies and setup assemblies for utilization in such a manner as to minimize object snag issues that may place children at risk. It is yet another objective of the present invention to provide a barrier structure that is stable and would not come apart or collapse during use.

In one aspect of the present invention, a first barrier assembly comprises: a sheet wound into a sheet roll having a hollow center to form a retracted configuration, the sheet being configured for unwinding from the sheet roll to form an outstretched barrier, the sheet having a leading edge; a pullout frame having a handle tube and an attaching bar, the leading edge of the sheet being attached to the attaching bar; a base housing adapted for placement onto a ground surface, the base housing containing a rear vertical extension and a front vertical extension; a tie rod having a hollow center and having a top opening and a bottom opening, the bottom opening being adapted for placement onto the rear vertical extension of the base housing; a reel tube adapted to fit inside the sheet roll, the reel tube being adapted to slide over the front vertical extension of the base frame; a torsion spring adapted to tightly fit inside the reel tube; the torsion spring being adapted for applying tension onto the outstretched barrier; and a locking assembly attached to the top of the sheet roll and the top of the tie rod.

In another aspect of the present invention, a barrier assembly comprises: a sheet wound into a sheet roll having a hollow center to form a retracted configuration, the sheet being configured for unwinding from the sheet roll to form an outstretched barrier, the sheet having a leading edge; a pullout frame having a handle tube and an attaching bar, the leading edge of the sheet being attached to the attaching bar; a base frame having a base housing adapted for placement onto a ground surface, the base housing containing a rear vertical extension and a front vertical extension; a tie rod having a hollow center and having a top opening and a bottom opening, the bottom opening being adapted for placement onto the rear vertical extension of the base housing; a reel tube adapted to tightly fit inside the sheet roll, the reel tube being adapted to slip onto the front vertical extension of the base frame; a torsion spring adapted to tightly fit inside the reel tube; the torsion spring being adapted for applying tension onto the outstretched barrier; and a housing assembly attached to the top of the sheet roll and the top of the tie rod.

In yet another aspect of the present invention, a barrier assembly comprises: a sheet wound into a sheet roll having a hollow center to form a retracted configuration, the sheet being configured for unwinding from the sheet roll to form an outstretched barrier, the sheet having a leading edge; a pullout frame having a handle tube and an attaching bar, the leading edge of the sheet being attached to the attaching bar; a base frame having a base housing adapted for placement onto a ground surface, the base housing containing a rear vertical extension and a front round opening; a tie rod having a hollow center and having a top opening and a bottom opening, the bottom opening being adapted for placement onto the rear vertical extension of the base housing; a reel tube adapted to tightly fit inside the sheet roll, and a bottom of the reel tube being adapted to slip through the front round opening in the base frame; and a locking assembly attached to the top of the sheet roll and the top of the tie rod.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

The barrier of the present invention is a sheet configured for being wound into a roll, for unwinding from the roll, to extend laterally from the roll to form a barrier, and for retracting back into a roll form. The sheet may be made from a fabric or fabric mesh; however, other materials, such as plastic or metal, also fall within the scope of the present invention. The retractable barrier assembly is configured for controlling the span, position and tension on the sheet.

FIGS. 1-28 illustrate embodiments of three barrier assemblies and in-use configurations using these assemblies.

Figure 1:
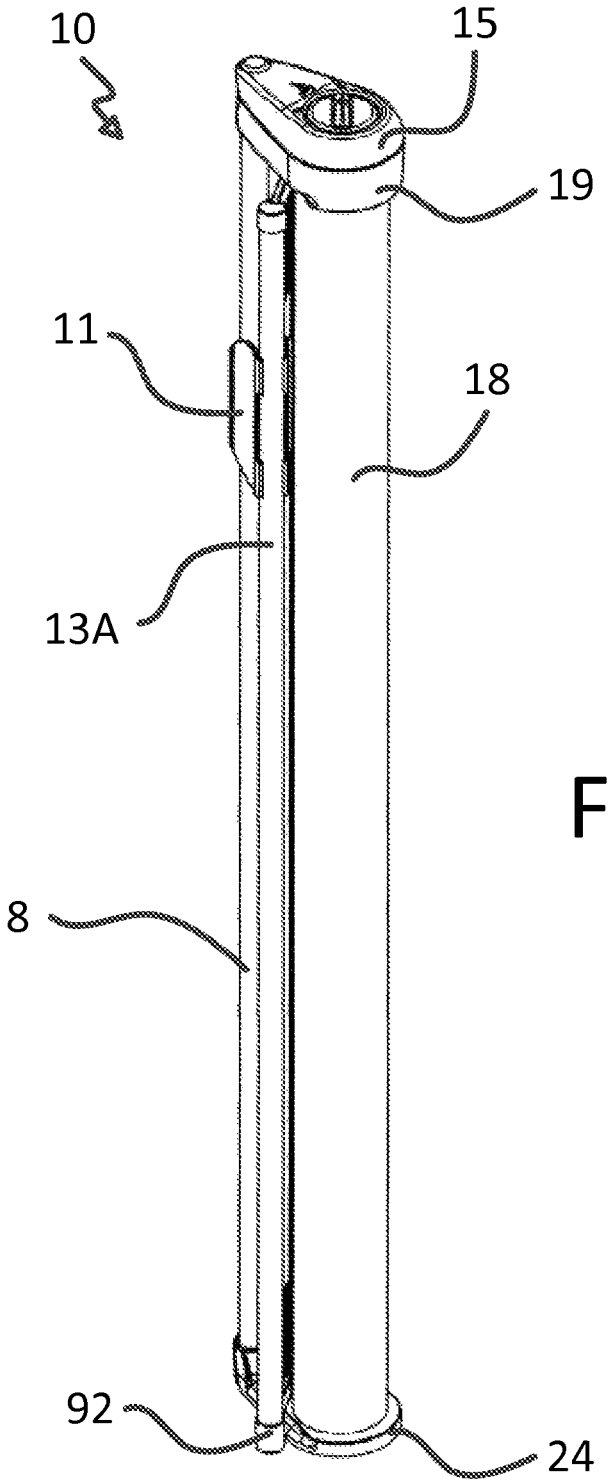
FIG. 1 shows a perspective view of a first embodiment of an assembly for outstretching and retracting a barrier.
Figure 2:
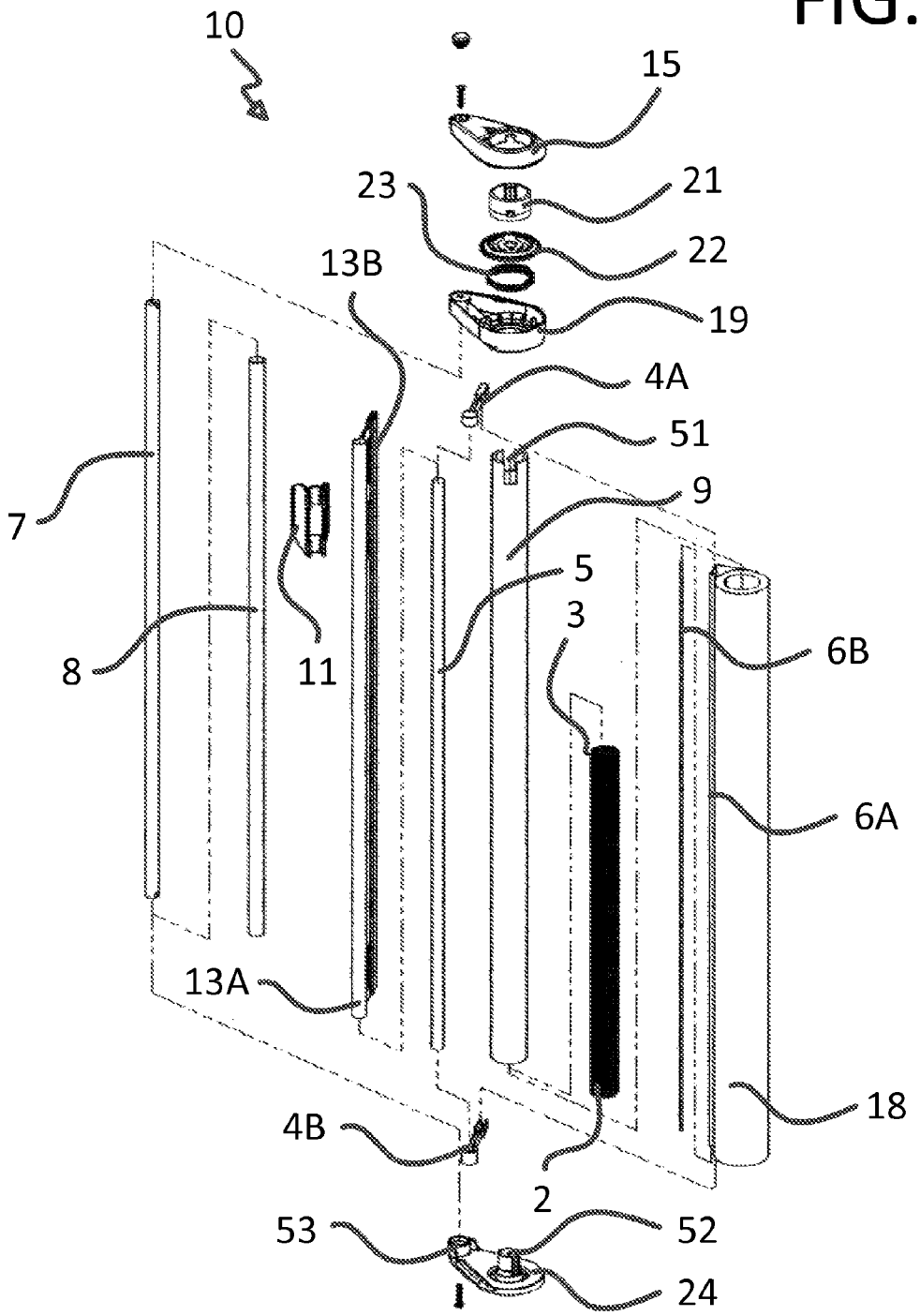
FIG. 2 is an exploded view of the first embodiment of an assembly for outstretching and retracting a barrier.
Figure 3:
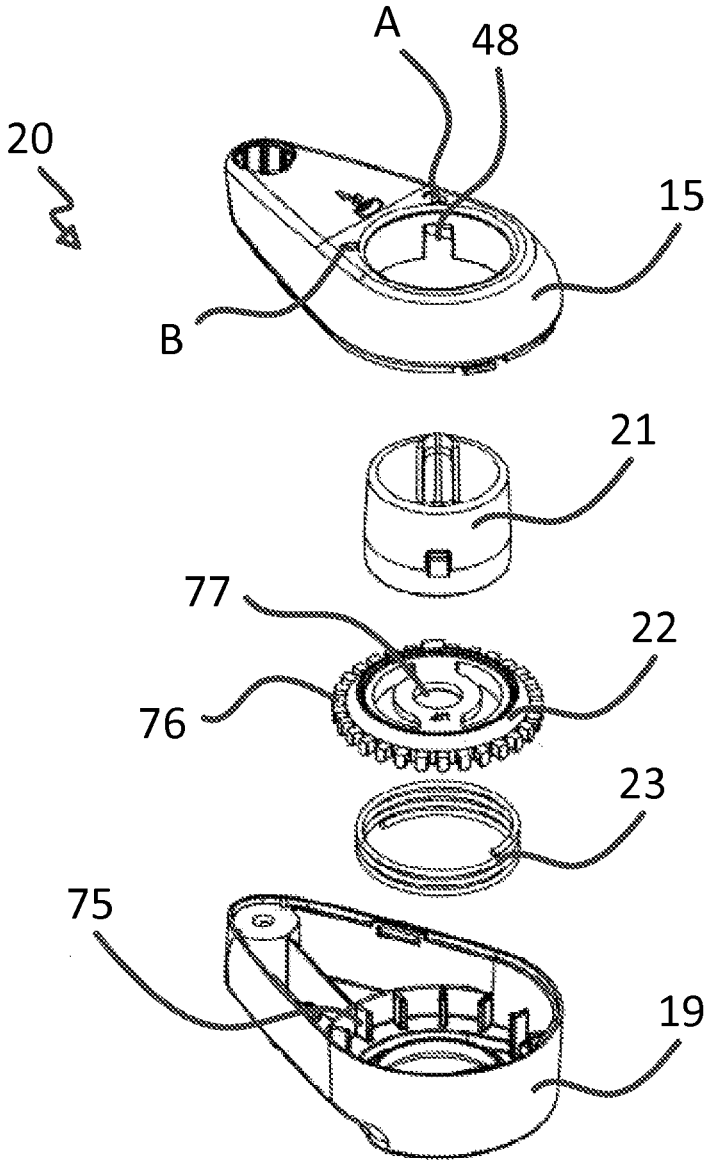
FIG. 3 is an exploded view of a barrier locking assembly according to an embodiment of the present invention.
Figure 4:
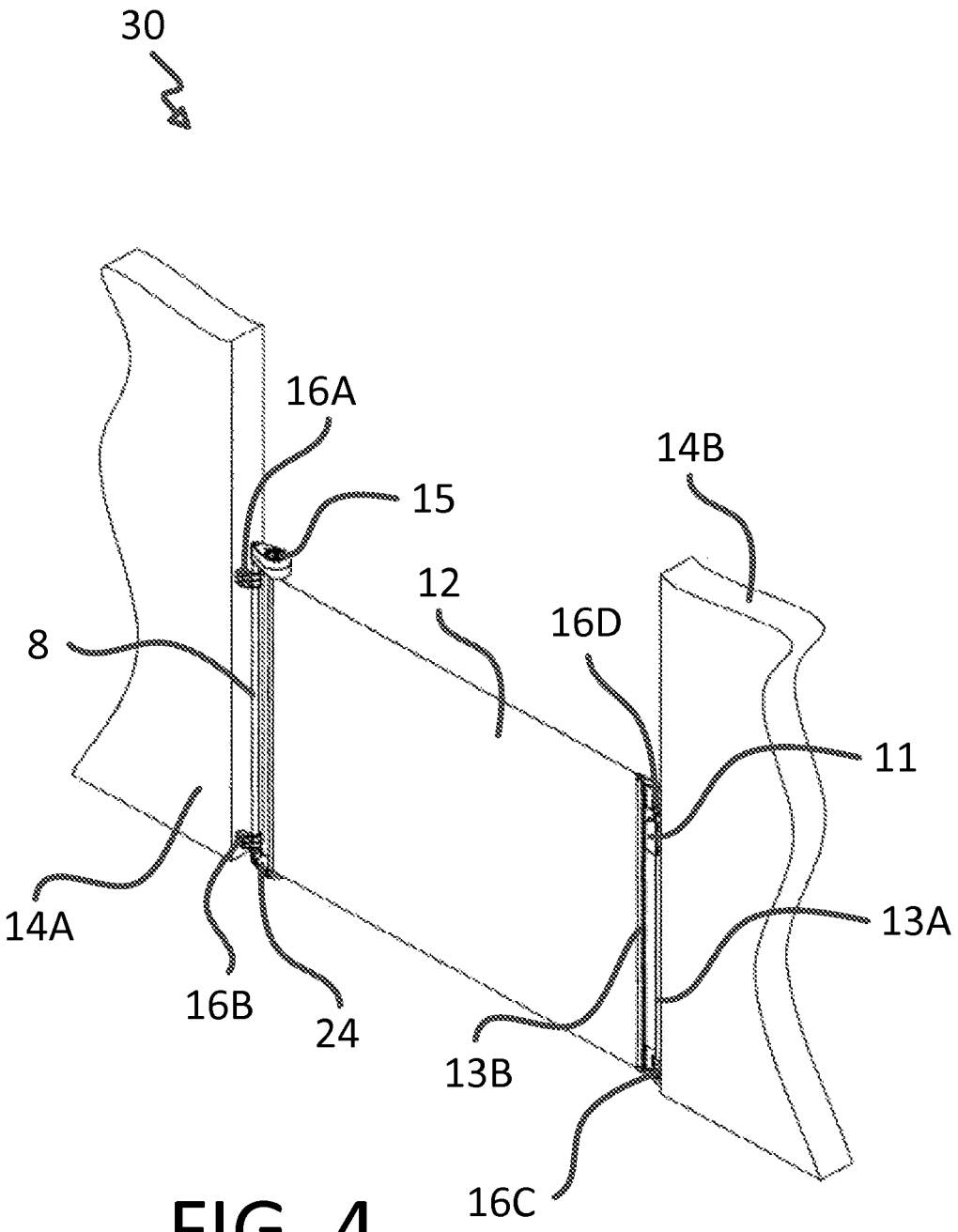
FIG. 4 is a perspective view of the first embodiment of an assembly for outstretching and retracting a barrier in a first use configuration.
Figure 5:
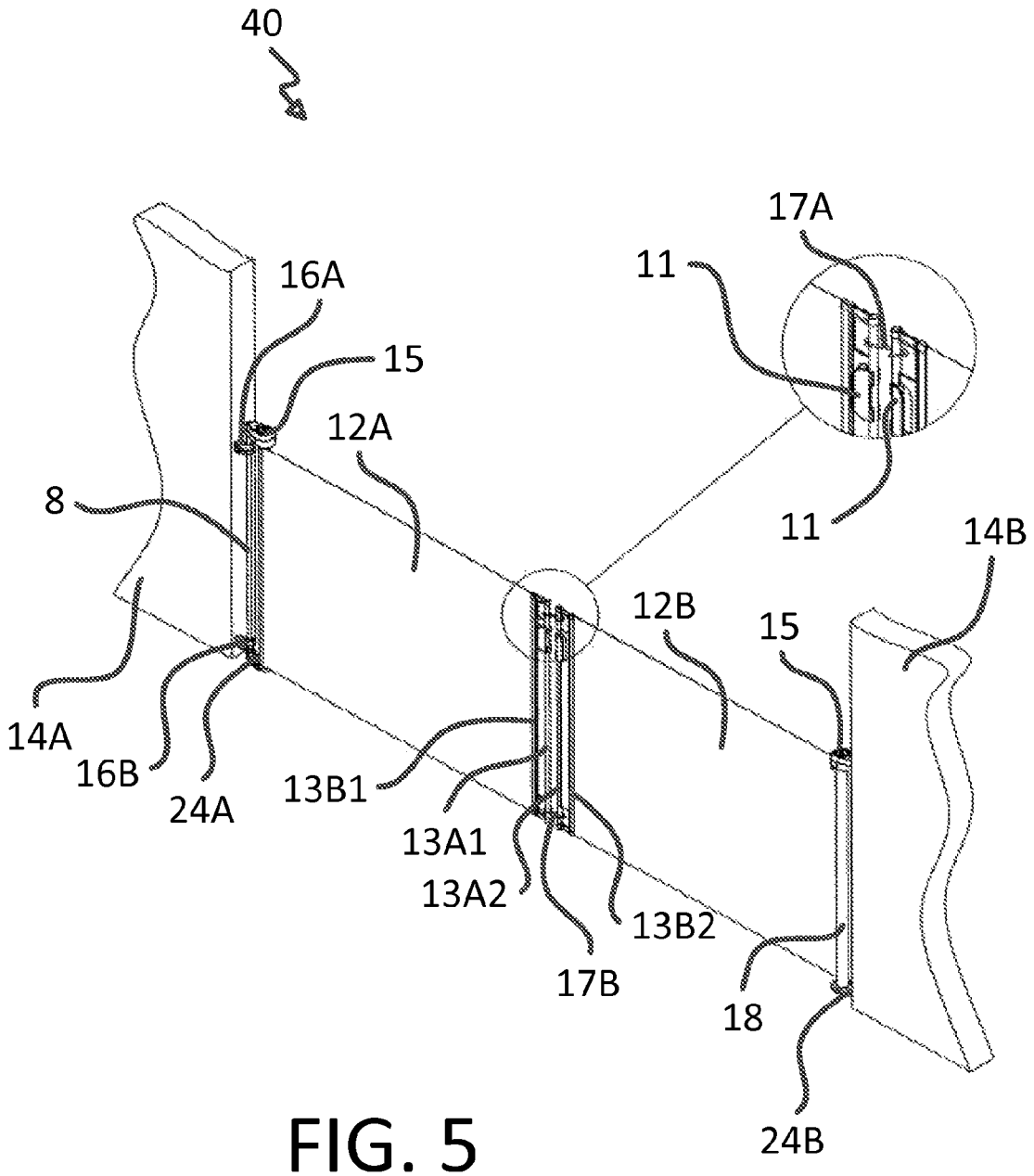
FIG. 5 a perspective view of the first embodiment of an assembly for outstretching and retracting a barrier in a second use configuration.
Figure 6:
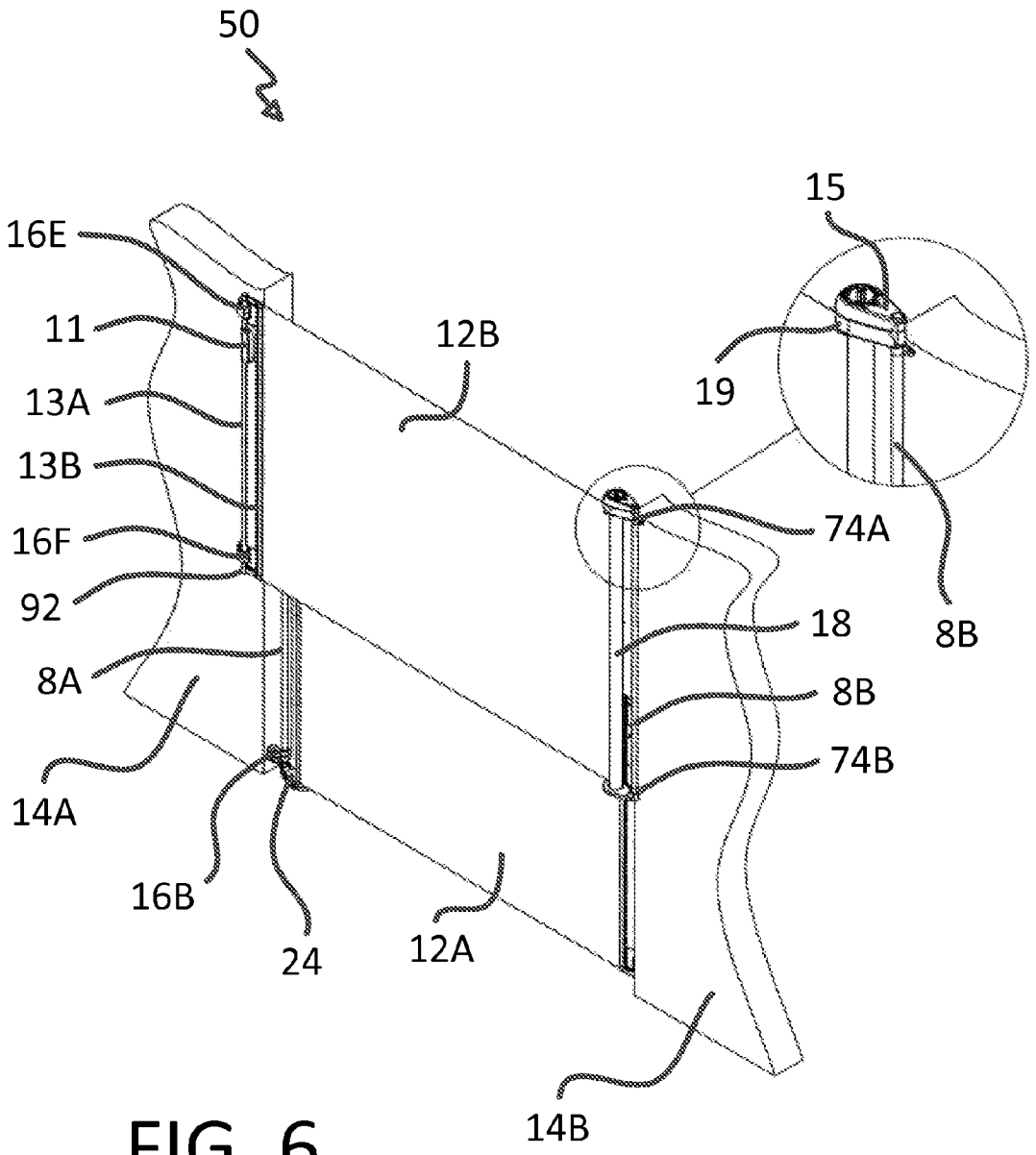
FIG. 6 is a perspective view of the first embodiment of an assembly for outstretching and retracting a barrier in a third use configuration.
Figure 7:
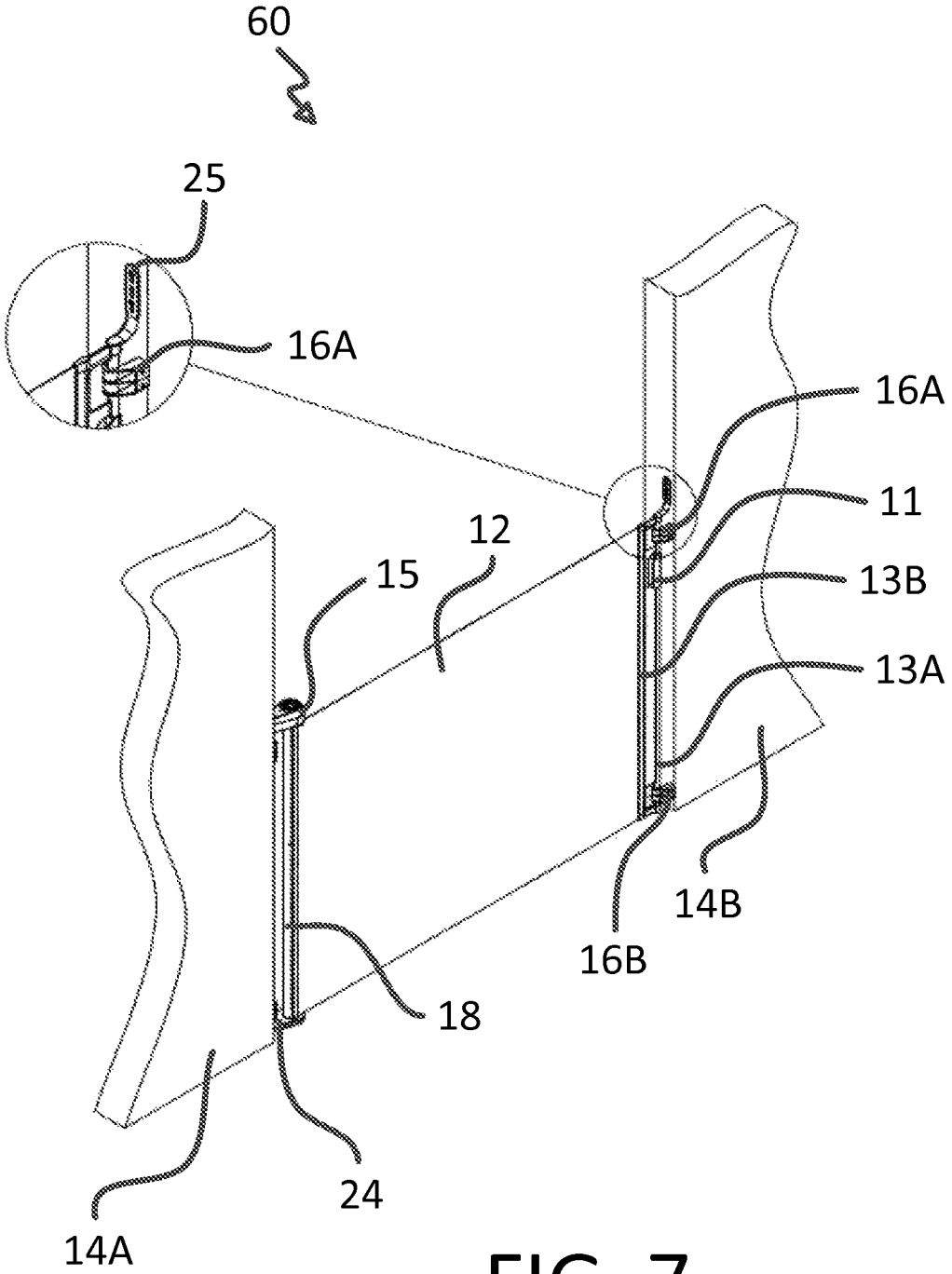
FIGS. 7 and 8 illustrate perspective views of the first embodiment of an assembly for outstretching and retracting a barrier in a fourth use configuration.
Figure 8:
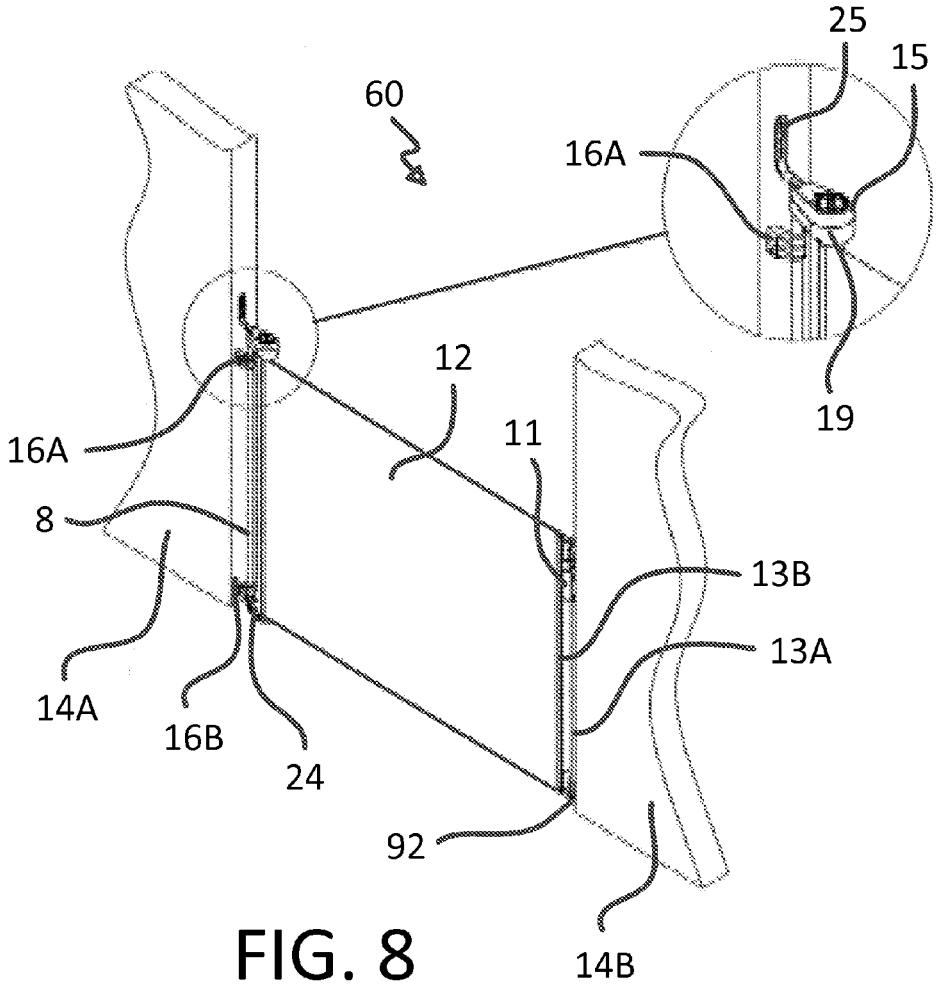
Figure 9:
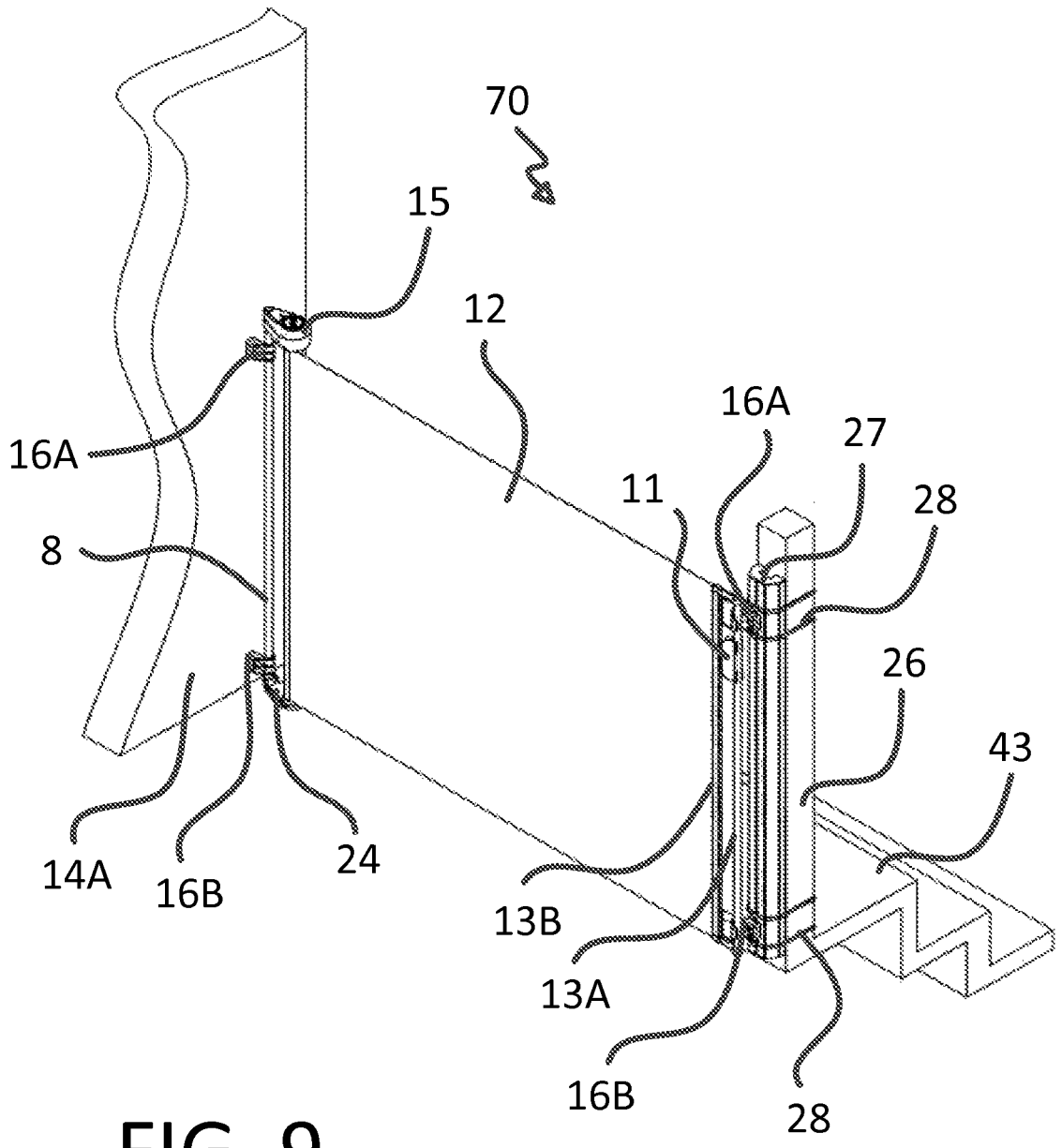
FIG. 9 is a perspective view of the first embodiment of an assembly for outstretching and retracting a barrier in a fifth use configuration.
Figure 13:
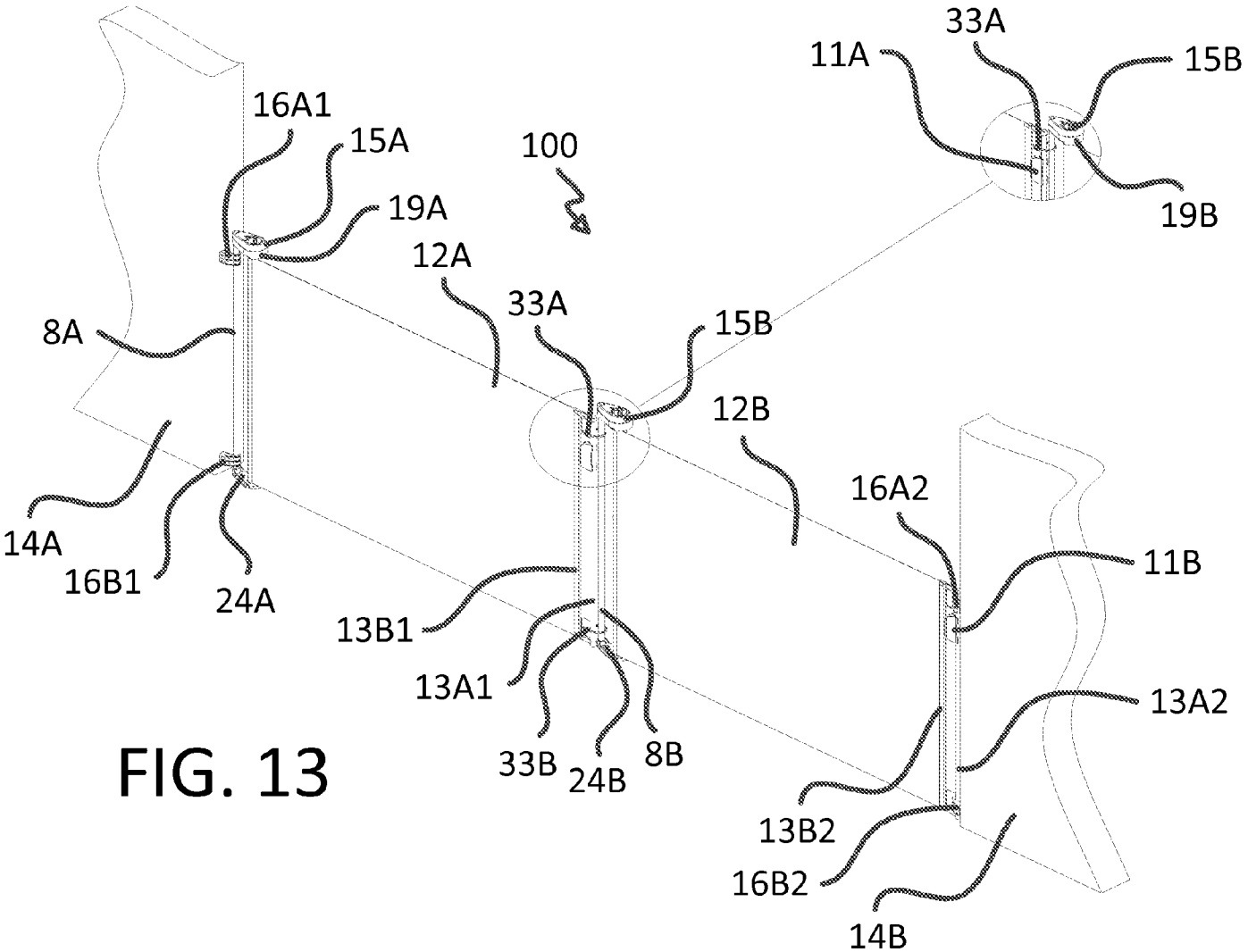
FIG. 13 is a perspective view of the first embodiment of an assembly for outstretching and retracting a barrier in a seventh use configuration.

FIGS. 1-3 and 28 show the construction of a first assembly for a barrier. FIGS. 4-13 present setups of barriers using the first assembly between two walls. The span between the walls varies and is a determining factor in selecting the configuration most appropriate for erecting the barrier. The barriers shown in FIGS. 4, 7-9, 11 and 27 cover relatively short spans between walls 14A and 14B. Generally, this configuration is suitable for spans ranging between about 8 to about 25 feet. FIG. 6 portrays a setup of two barriers erected one over the other. This setup would be used if the height blocked by a single barrier is not sufficient, such as blocking a dog that might jump over a single barrier. In FIGS. 5 and 13, two barriers are combined to cover a large span between two walls. With these setups, two barriers are needed, as the wall to wall span is larger than what a single barrier using the first assembly construction is capable of covering.

Figure 14:
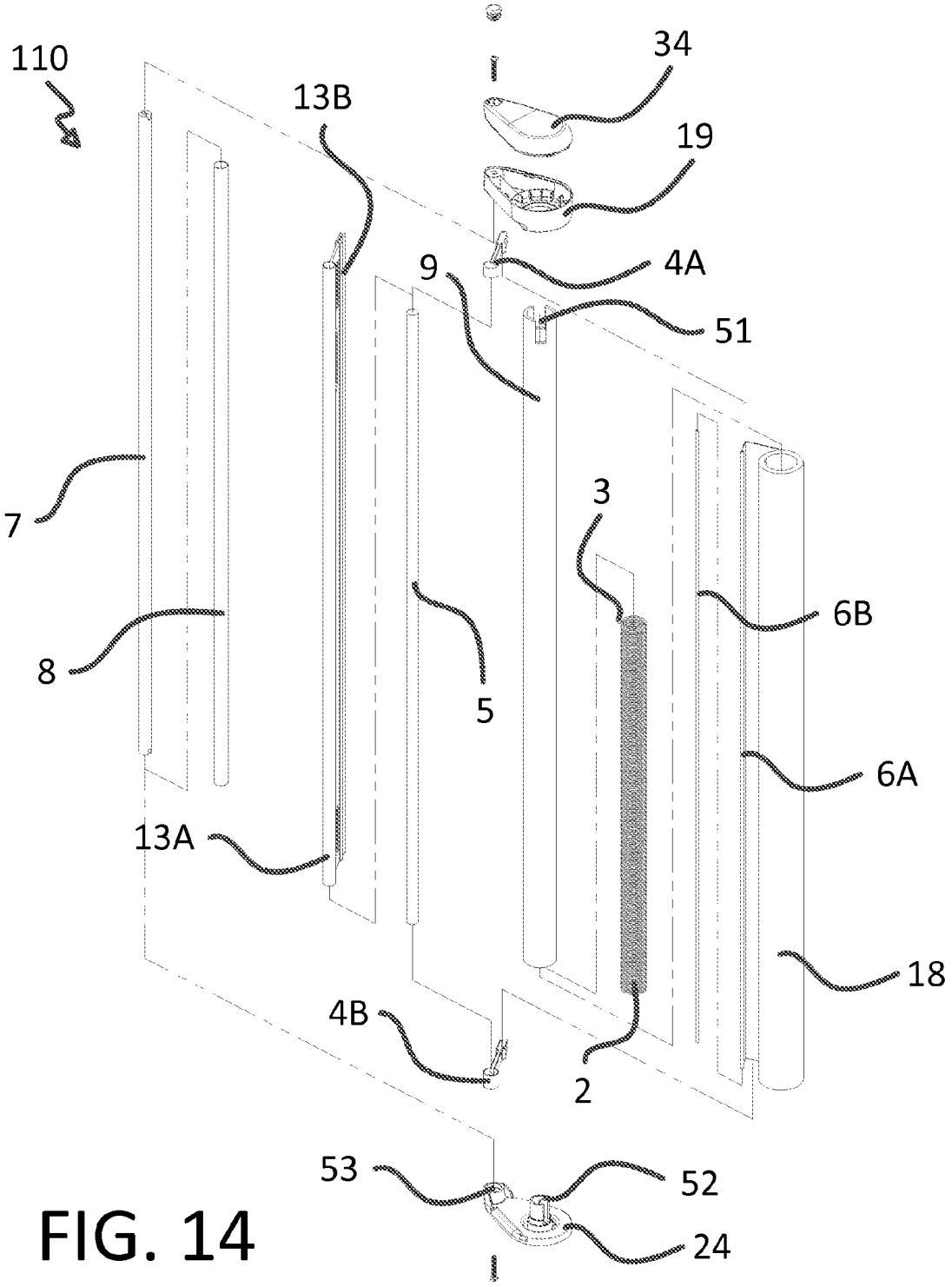
FIG. 14 is an exploded view of a second embodiment of an assembly for outstretching and retracting a barrier.
Figure 15:
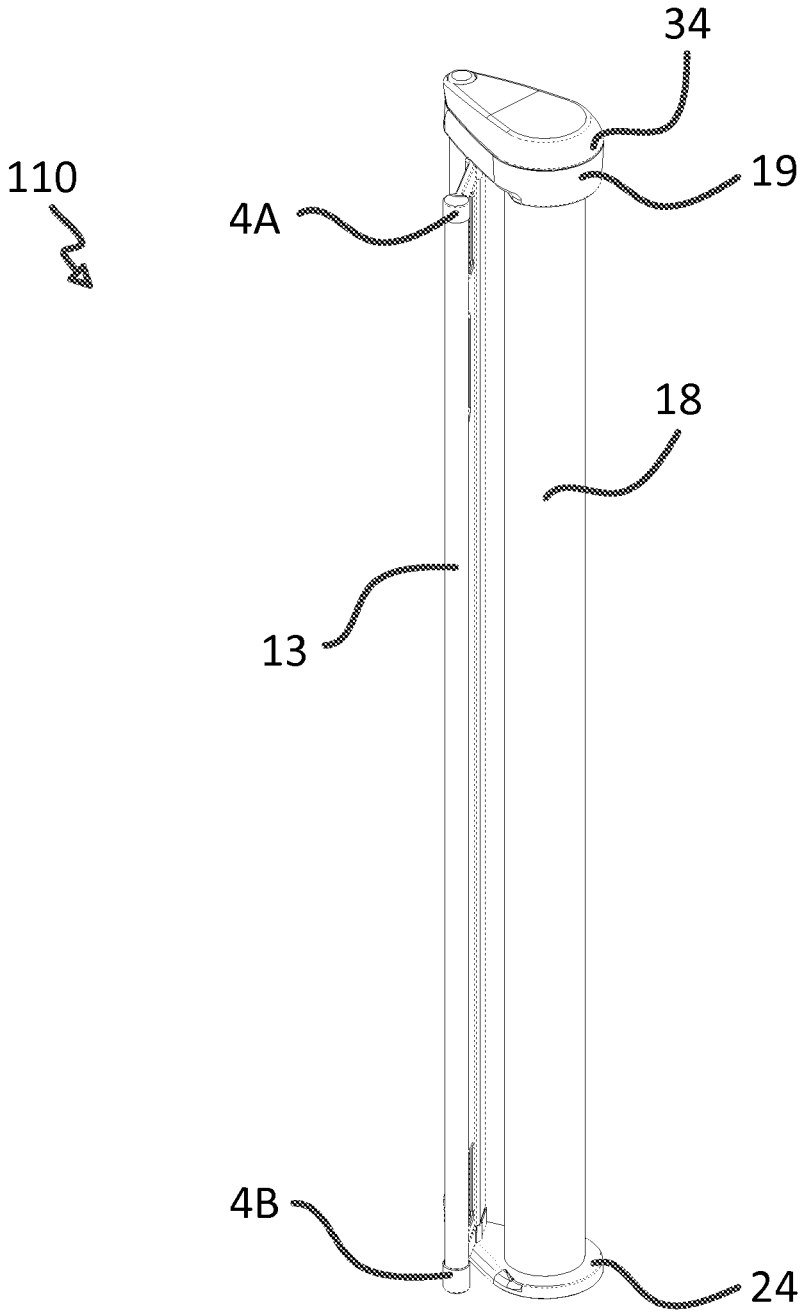
FIG. 15 is a perspective view of a second embodiment of an assembly for outstretching and retracting a barrier.
Figure 16:
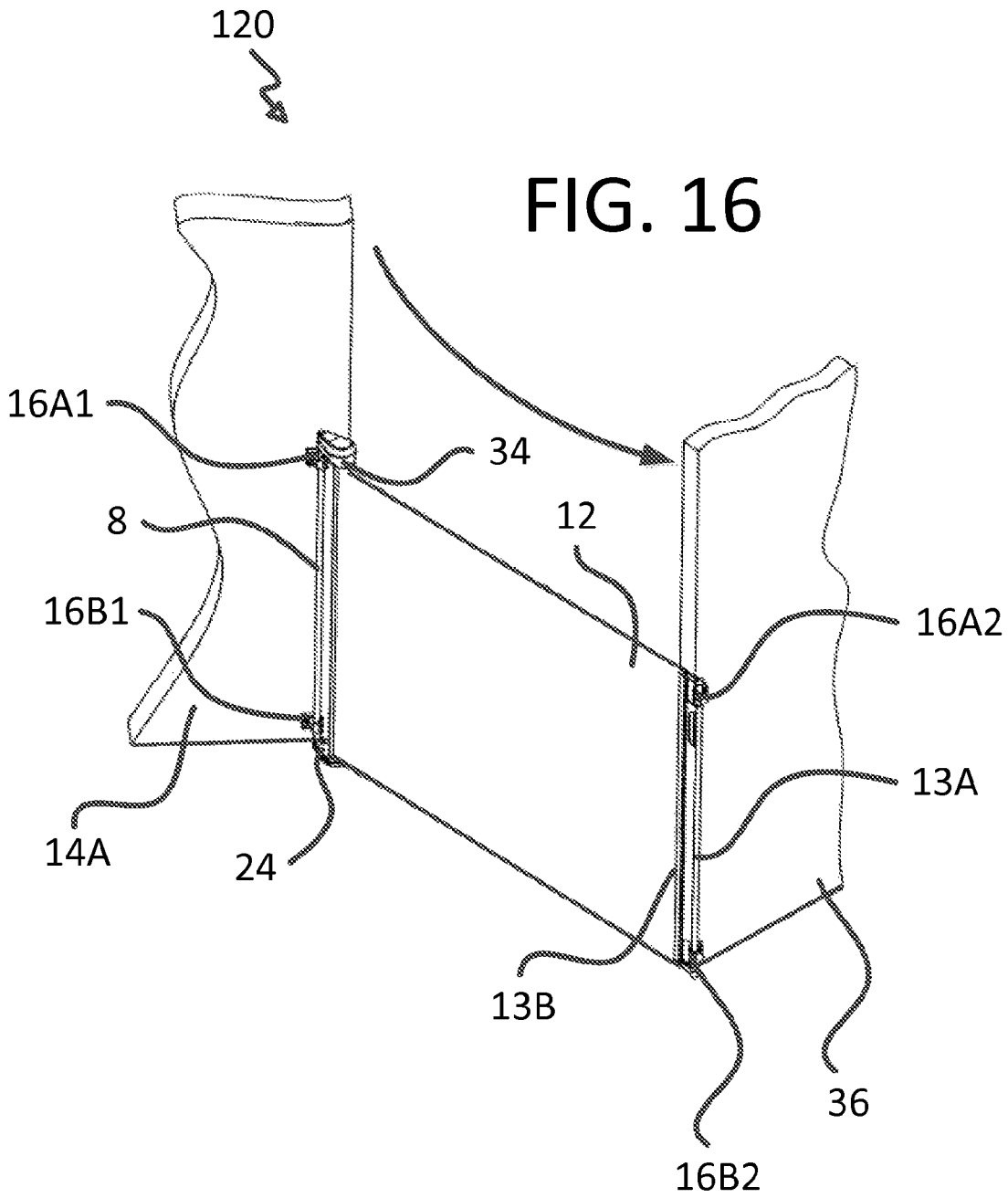
FIG. 16 is a perspective view of the second embodiment of an assembly for outstretching and retracting a barrier in a use configuration.

FIGS. 14-15 show the construction of a second assembly for a single barrier. FIG. 16 depicts the setup of a barrier using this assembly. The barrier is erected between a wall and a front edge of a door that opens and closes.

Figure 17:
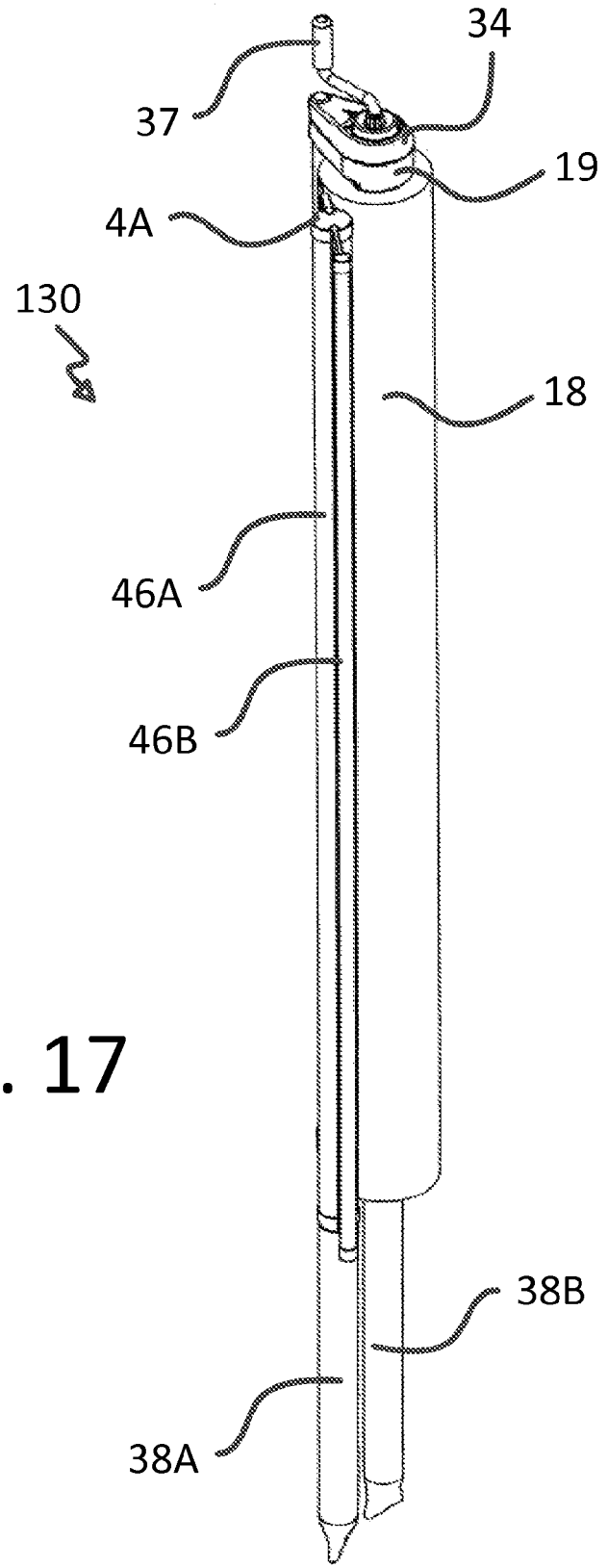
FIG. 17 is a perspective view of a third embodiment of an assembly for outstretching and retracting a barrier.
Figure 18:
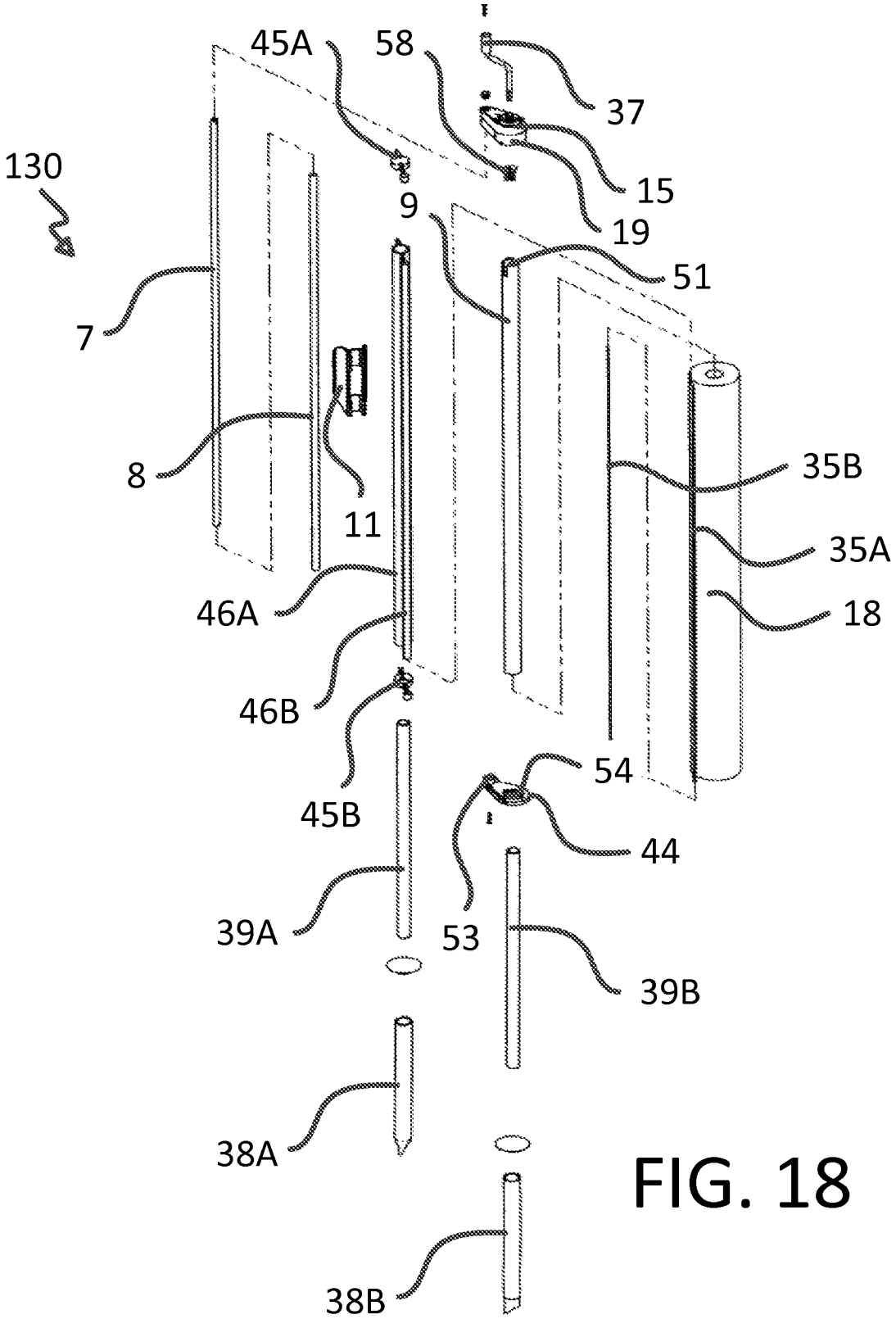
FIG. 18 is an exploded view of the third embodiment of an assembly for outstretching and retracting a barrier.
Figure 19:
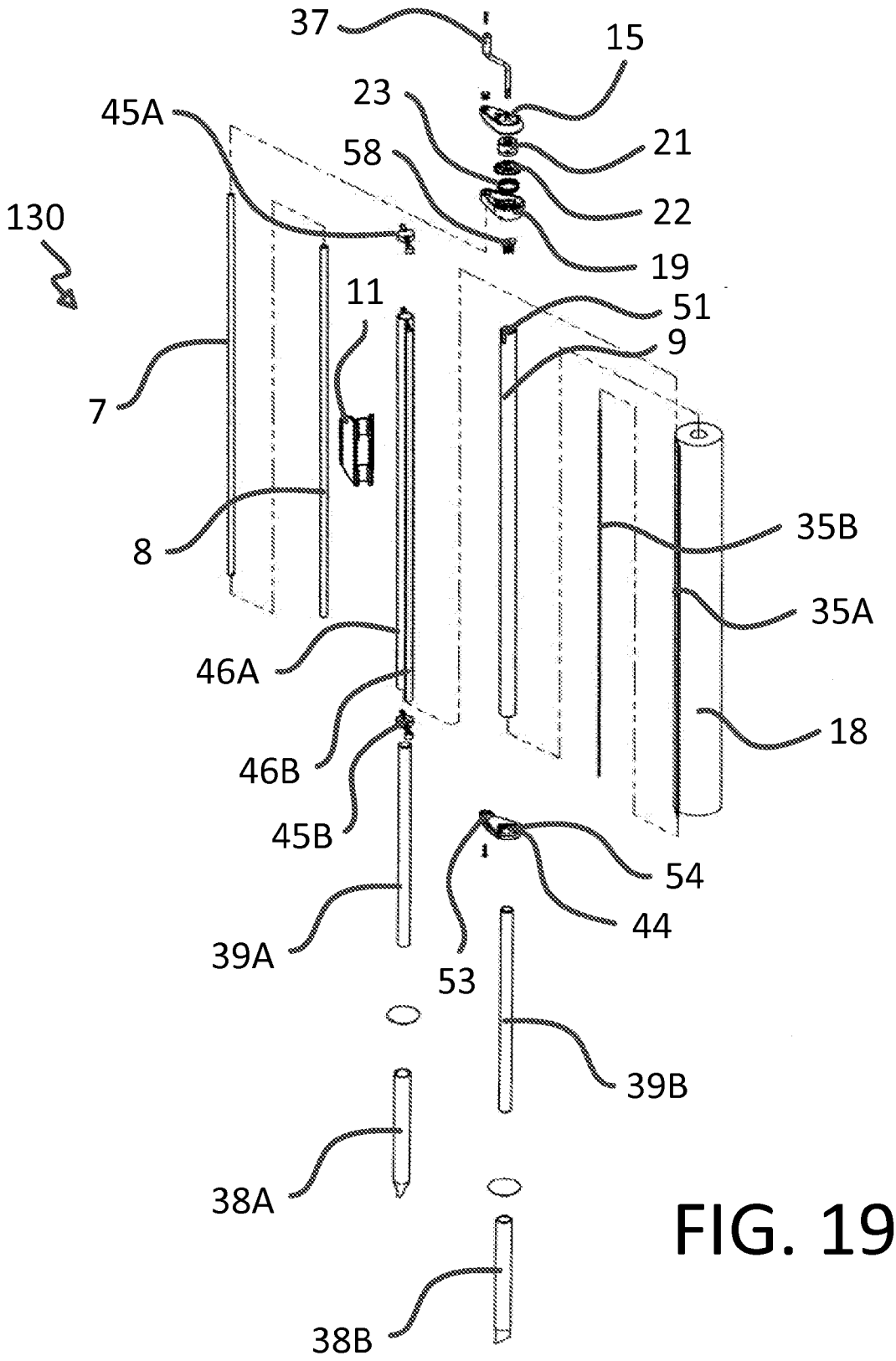
FIG. 19 is another exploded view of a third embodiment of an assembly for outstretching and retracting a barrier.
Figure 20:
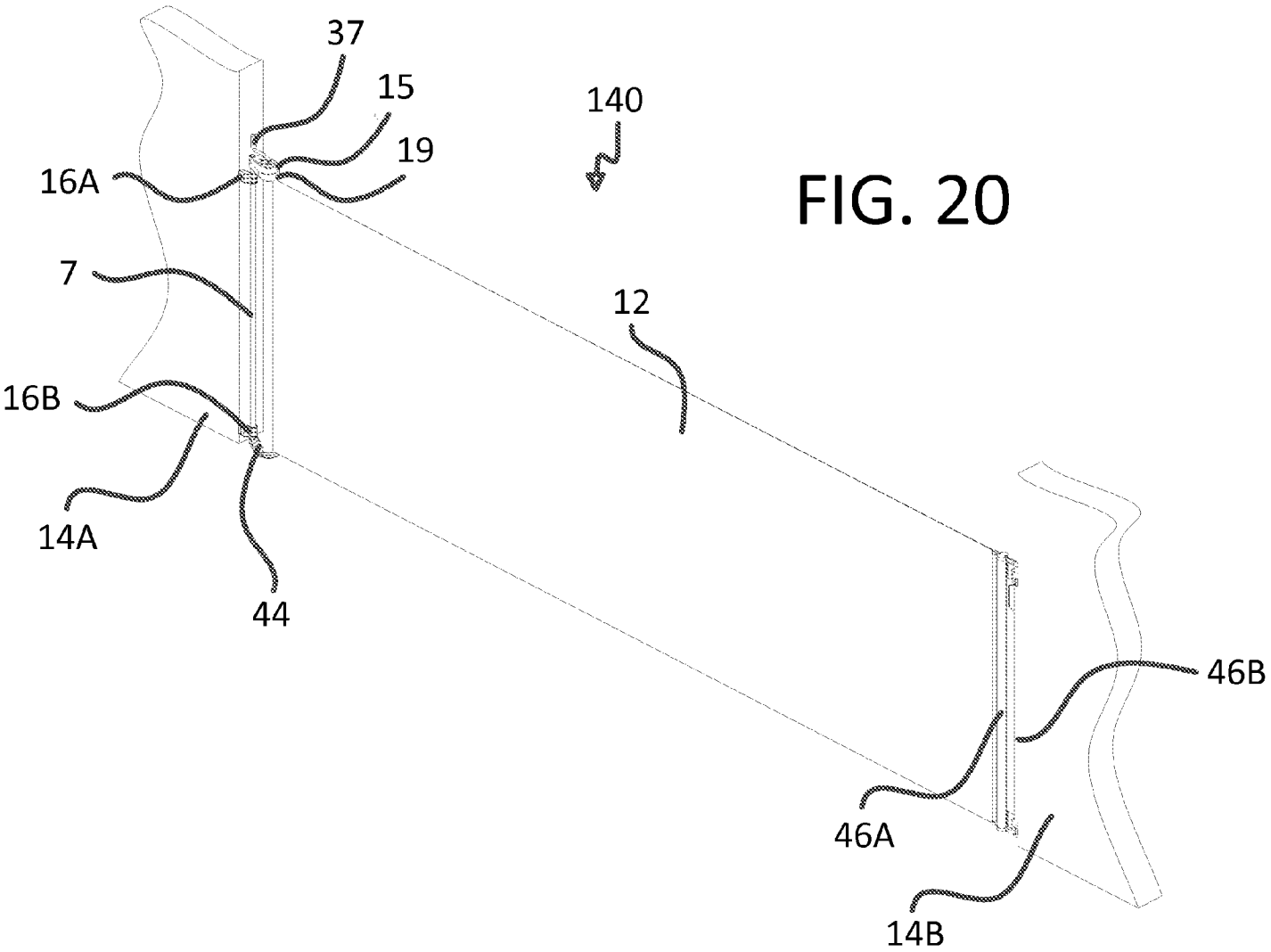
FIG. 20 is a perspective view of the third embodiment of an assembly for outstretching and retracting a barrier in a first use configuration.
Figure 21:
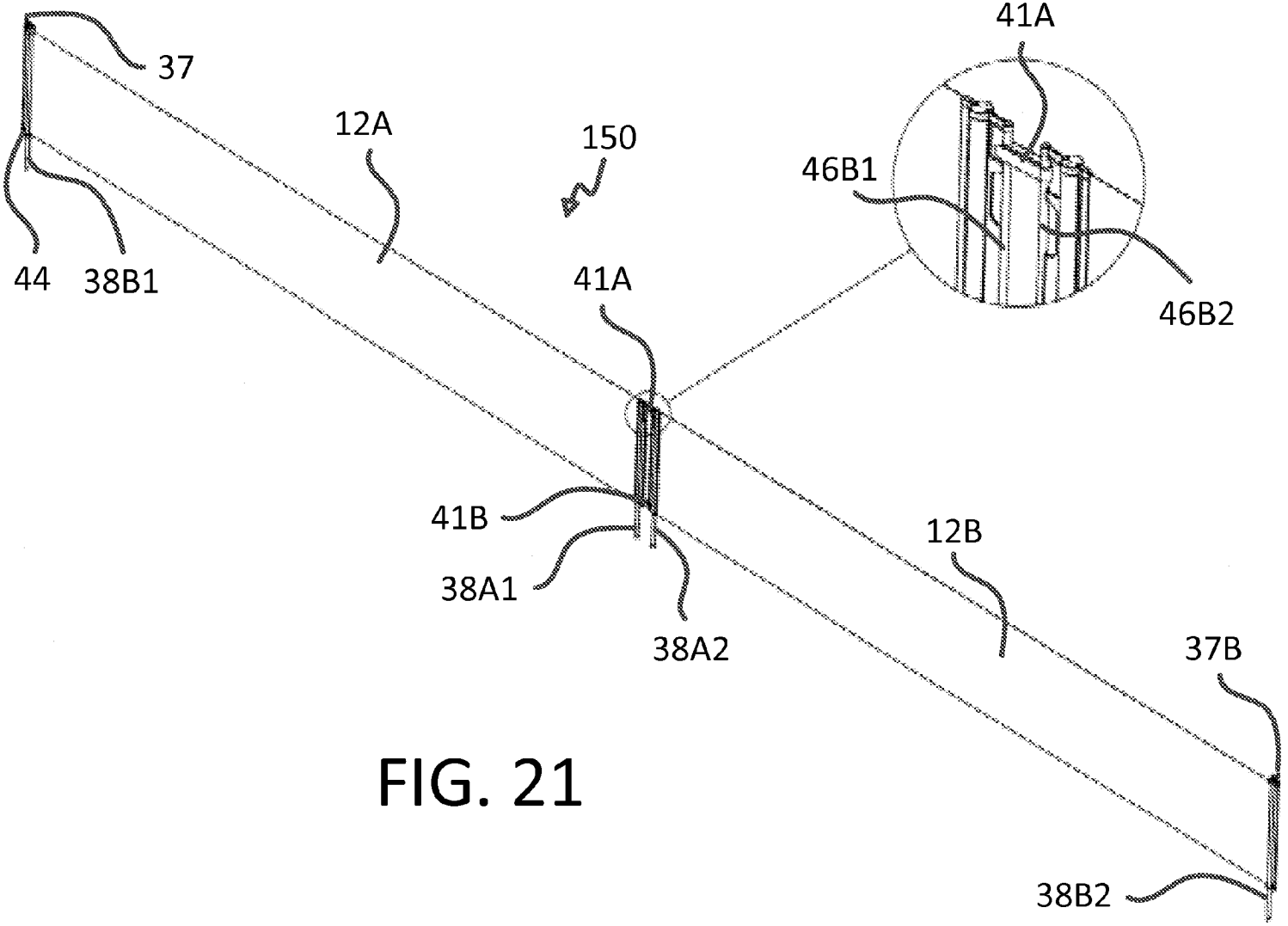
FIG. 21 is a perspective view of the third embodiment of an assembly for outstretching and retracting a barrier in a second use configuration.
Figure 22:
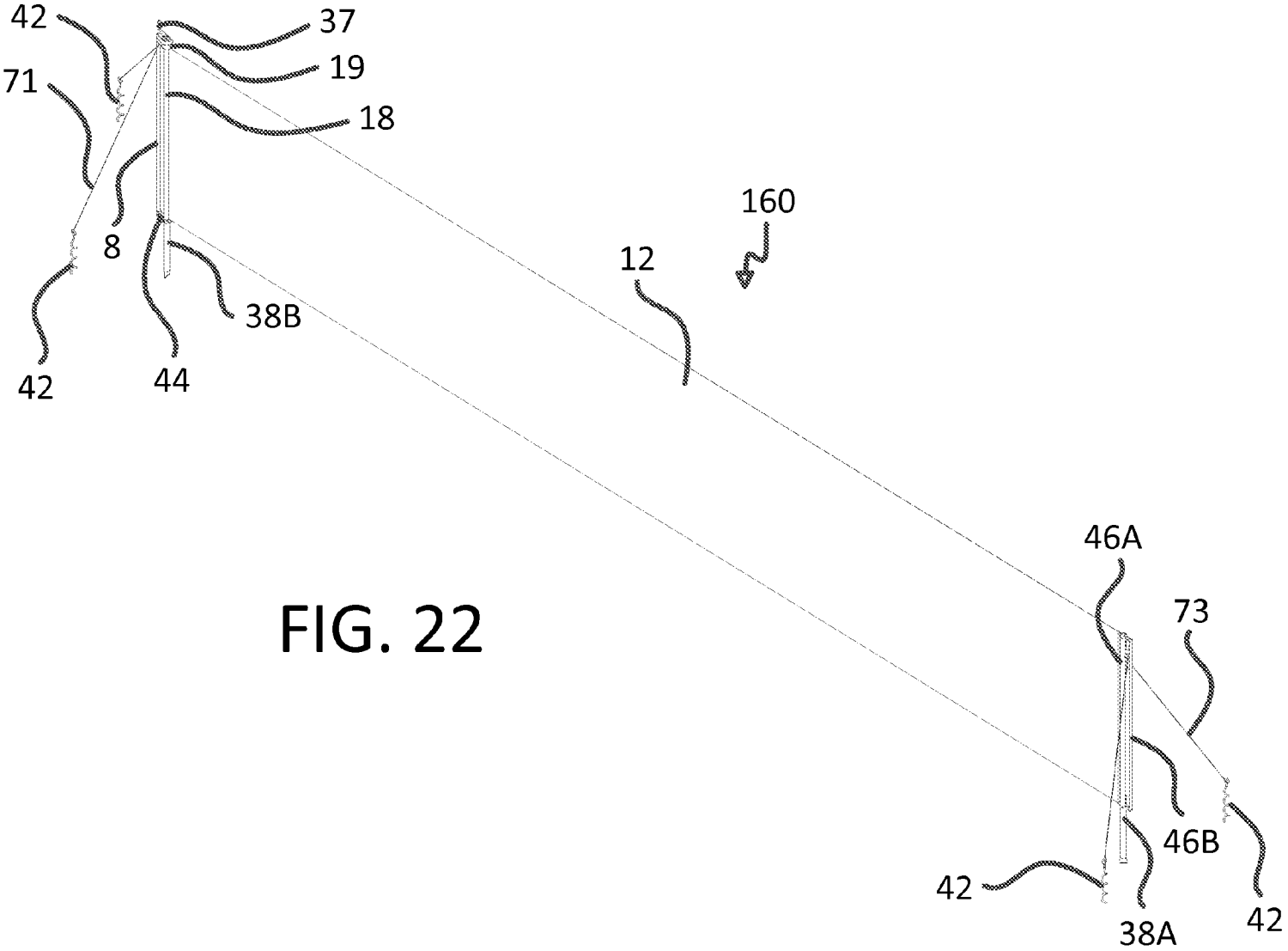
FIG. 22 is a perspective view of the third embodiment of an assembly for outstretching and retracting a barrier in a third use configuration.
Figure 23:
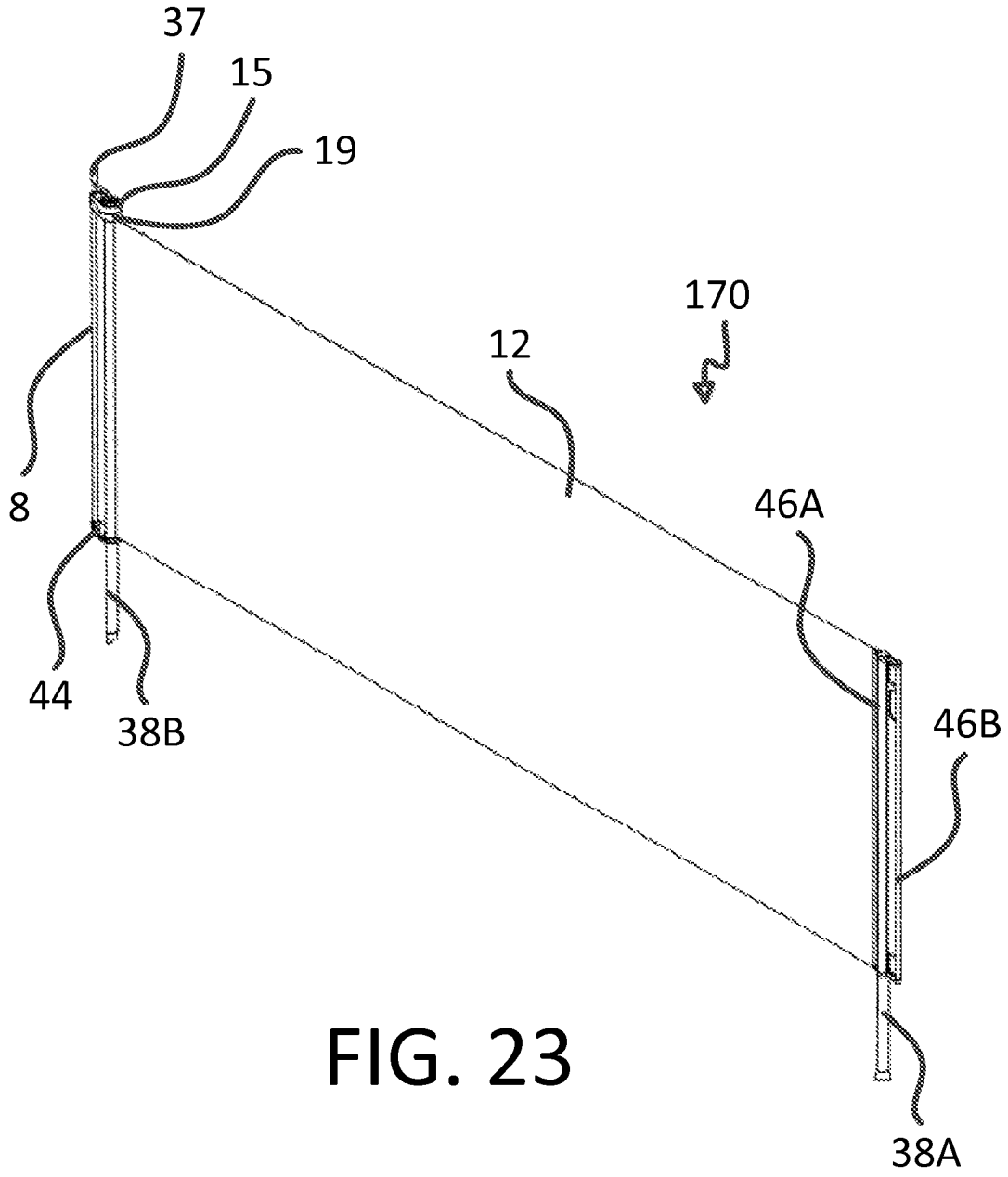
FIG. 23 is a perspective view of the third embodiment of an assembly for outstretching and retracting a barrier in a fourth use configuration.
Figure 24:
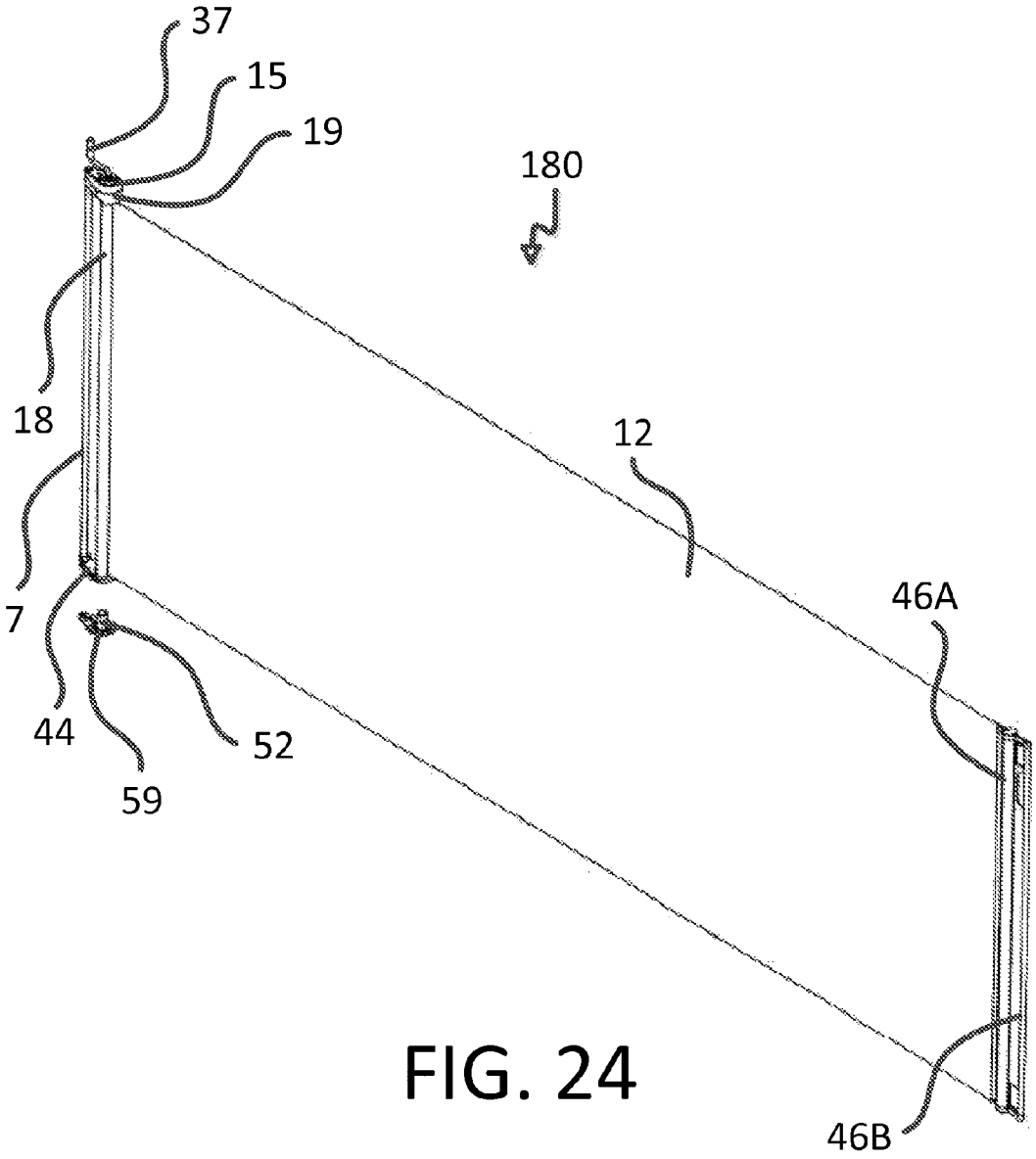
FIG. 24 is a perspective view of the third embodiment of an assembly for outstretching and retracting a barrier in a fifth use configuration.

FIGS. 17-19 show the construction of a third assembly for a single barrier. FIGS. 20-24 describe various setup embodiments of barriers using the third assembly to cordon off a defined span. The third barrier assembly is most suitable for covering long spans between two points, typically greater than about 25'. The third barrier assembly is typically useful, though not limited to, outdoor areas. FIG. 21 illustrates a setup of two barriers that utilize the third barrier assembly which combine to fence off a relatively large span.

The first barrier assembly 10 comprises a sheet 12 wound into a roll 18. The sheet material of construction is preferably a flexible yet strong fabric. The mesh of the fabric may be open or closed. However, other materials of construction, such as metal or plastic, also fall within the scope of the present invention. The leading edge of the sheet 12 is attached to a frame structure that contains a handle tube 13A and an attaching bar 13B. Torsion spring roll 2 fits inside reel tube 9, which has an upper slot 51, such that hook 3 disposed at the top of the torsion spring roll 2 is seated inside slot 51. The back end of the sheet is attached to reel tube 9 and the sheet is wrapped around reel tube 9 such that it is disposed inside sheet roll 18. An upper cap knob 4A covers openings in the upper portion of handle tube 13A and attaching bar 13B. A lower cap knob 4B covers openings in the lower portion of handle tube 13A and attaching bar 13B. The cap knobs 4A and 4B help stop the sheet 12 as it is pulled back to wind into the roll 18. The cap knobs also help prevent snag issues. The handle tube 13A and the reel tube 9 are hollow inside.

The attachment of the sheet 12 to the attaching bar 13B is accomplished through loop 6A and spline 6B inserted into attaching bar 13B. The leading edge of the sheet 12 is folded over loop 6A and sewn onto it. Spline 6B is attached onto the loop 6A to further reinforce the attachment. It is noted that other attachment means of the sheet 12 onto the attaching bar also fall within the scope of the present invention. These include but are not limited to: fusing the ends of the sheet 12 to the attaching bar 13B, wedging the sheet 12 in a slot in the attaching bar 13B and clipping the sheet to the attaching bar 13B. A reinforcement rod 5 made of a rigid plastic material is inserted inside the handle tube 13A for further reinforcement. A handle grip 11 is snapped onto handle tube 13A. It allows the user a good grip to pull out the handle tube 13A and the sheet 12 along with it. The handle grip 11 is configured to swivel about 30 degrees to each side of handle tube 13A.

The first barrier assembly 10 is placed vertically onto an indoor floor or outdoor ground. The barrier assembly 10 is subjected to forces exerted by the pulling out and retracting of the sheet. It is therefore important to construct the assembly 10 such that it is stable, that it would not come apart in use or collapse. A number of provisions are made to reinforce the structure. A tie rod 7 placed at the rear of the assembly with the bottom opening placed over rear vertical extension 53 of base housing 24 while the reel tube 9 is placed over front vertical extension 52 of base housing 24. Protective sleeve 8 slips over tie rod 7 to provide rigidity.

The first barrier assembly 10 contains a locking assembly configured for preventing the sheet from inadvertently retracting when outstretched under tension. Sheet locking assembly 20 contains an upper housing member 15 and middle housing member 19 which are combined to form a housing enclosure. Middle housing member 19 contains a plurality of fixed internal gear teeth 75 and is open at the bottom center. Compression spring 23 is open in the center and is placed inside the middle housing member 19. Gear member 22 containing a plurality of teeth 76 and center opening 77 is placed over the compression spring 23. Knob 21 is placed into slot 48 of upper housing member 15 and is configured to turn inside the slot 48 to position "A" and a lower position "B". The knob 21 is configured to lock in place in both positions "A" and "B". In position "B", the knob 21 applies a downward pressure onto the compression spring 23 and onto gear member 22, pushing gear member 22 into slot 51 of reel tube 9 and also placing it in position for its teeth 76 to engage with the internal gear teeth 75 of middle housing member 19. This prevents gear member 22 from rotating, and, in turn, prevents the reel tube 9 from turning. Moving the knob 21 to the higher position "A" releases the pressure on the compression spring which pushes the gear member 22 out of its engagement with the internal gear teeth 75 of middle housing 19 and out of engagement with the reel tube 9 making it free to turn. The upper housing member 15 having knob 21 attached to it and the lower housing member 19 containing the gear member 22 and compression spring 23 are configured to combine and form the locking assembly.

The bottom back end of the middle housing 19 of locking assembly 20 attaches to the top of tie rod 7, while the bottom front end of the middle housing 19 attaches to the top of sheet roll 18 and engages with the top of the reel tube 9. The attachment of the bottom back end of the middle housing 19 to the top of tie rod 7 may be done by screws or any other suitable attaching means.

Figure 10:
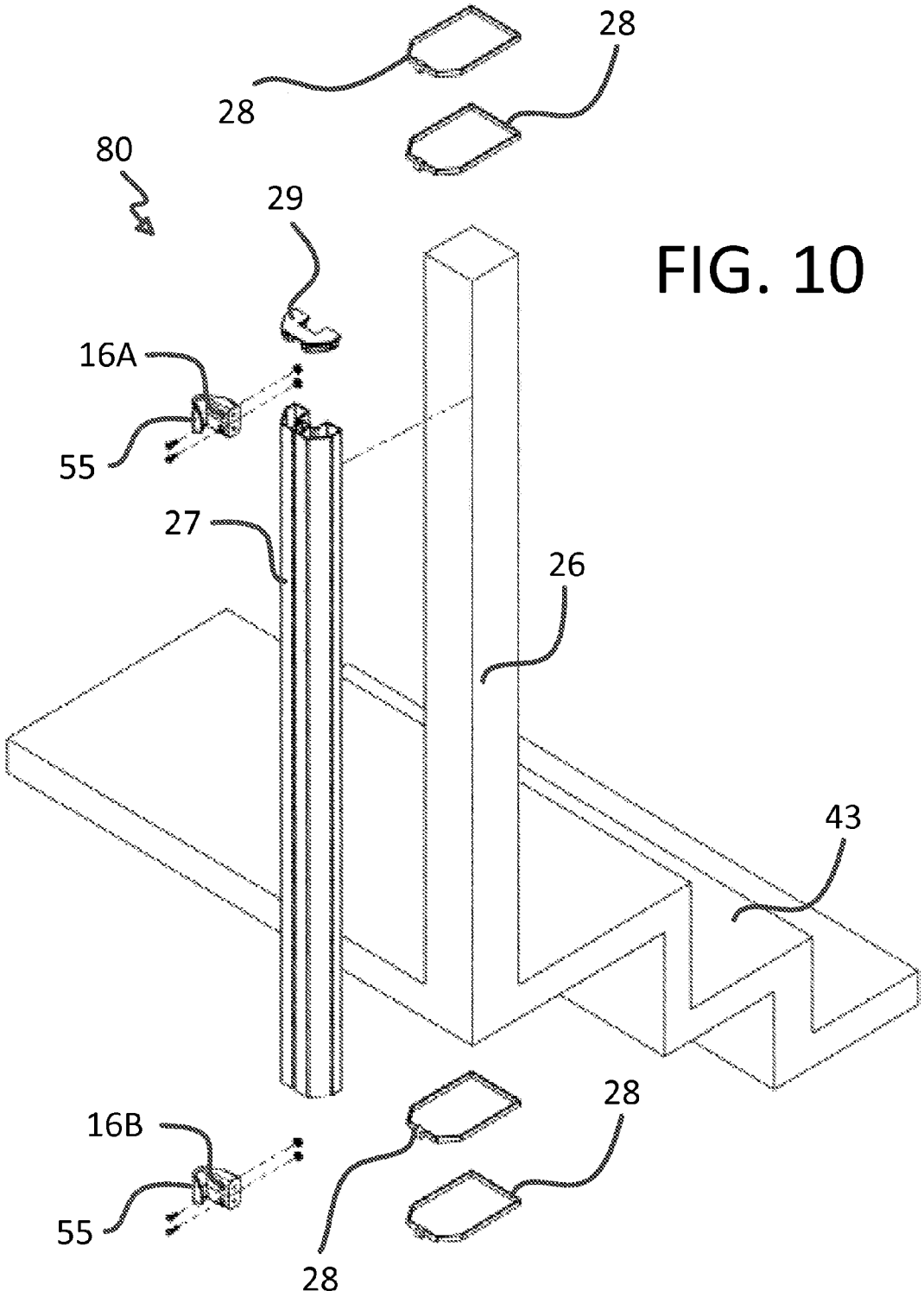
FIG. 10 is an exploded view of a component of the setup assembly of FIG. 9 according to an embodiment of the present invention.
Figure 11:
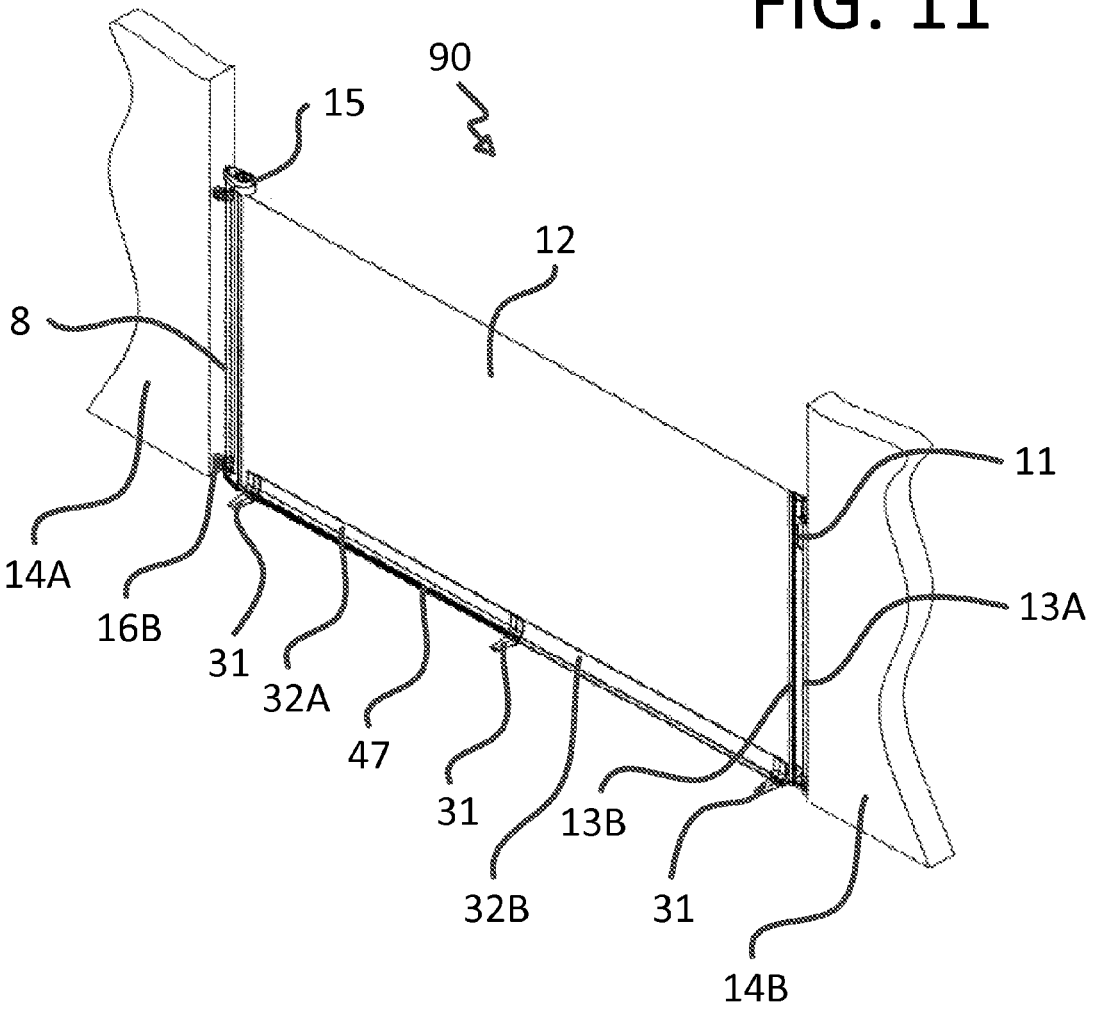
FIG. 11 is a perspective view of the first embodiment of an assembly for outstretching and retracting a barrier in a sixth use configuration.
Figure 12:
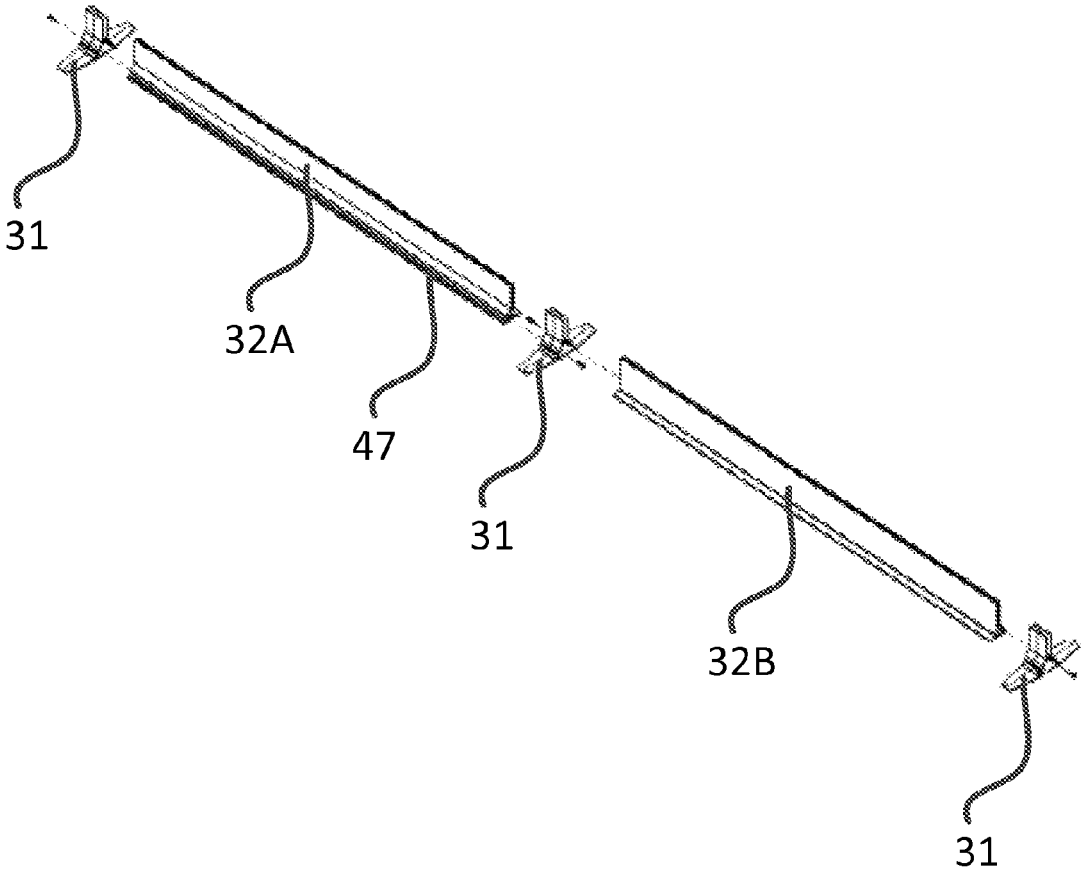
FIG. 12 illustrates an exploded view of a component of the setup assembly of FIG. 11 according to an embodiment of the present invention.

The barrier assembly 10 is installed between two walls in setup configuration 30 wherein the sheet 12 is extended between first wall 14A and second wall 14B. Two u-shaped brackets 16A and 16B, each having a curved arm 55 as shown in FIG. 10, are attached to the first wall 14A using screws. U-shaped bracket 16A is installed near the locking assembly at the top of barrier assembly 10, while u-shaped bracket 16B is installed near the base housing 24 at the bottom of barrier assembly 10. The bent arm 55 of the u-shaped brackets 16A and 16B are clipped onto sleeve 8 of tie rod 7 and hold the tie rod sleeve 8 close to the first wall 14A. Similarly, two u-shaped brackets 16C and 16D, each having a curved arm 55, are attached to the second wall 14B by screws. The curved arms 55 of u-shaped brackets 16C and 16D each clips onto handle tube 13A. The benefit of the u-shaped brackets 16 is the ease of installation and disassembly of the barrier. The handle tube 13A and tie rod sleeve 8 need to be only clipped onto and unclipped from the respective u-shaped brackets 16 for setup and disassembly to be accomplished.

Barrier assembly setup 40 is situated between a first wall 14A and a second wall 14B that are further apart than the distance that one barrier assembly 10 can cover. With this setup, two barrier assemblies 10 are combined front to front in order to form a long barrier. The back end of one barrier assembly 10 containing sheet 12A is attached to the first wall 14A, while the back end of the other barrier assembly 10 containing sheet 12B is attached to the second wall 14B. The handle tubes 13A1 and 13A2 of the two barrier assemblies 10 are attached to one another using s-hooks 17A and 17B. Tying together handle tubes 13A1 and 13A2 using hooks 17A and 17B prevents the two barrier assemblies 10 from retracting while they are under tension and prevents the barrier sheets 12A and 12B from folding from the weight of the respective pullout frames if the locking assemblies 20 of the two barrier assemblies 10 are engaged and are thus not under tension.

In setup 50, two barrier assemblies 10 are combined to cover a higher gap between wall 14A and wall 14B that face each other. With this setup, the assembly containing the first barrier sheet 12A is attached to the surfaces of walls 14A and 14B that face each other close to the floor as with setup 30. However, the assembly with the second barrier sheet 12B is attached to the surfaces of walls 14A and 14B that corner and are perpendicular to the parallel surfaces of walls 14A and 14B situated mostly above the first barrier sheet 12 with some overlap. The u-shaped brackets 16A (not shown) and 16B are used for attaching tie rod 8A of the first barrier assembly to the surface of the first wall 14A. Similarly, u-shaped brackets 16C and 16D (not shown) are used for attaching the handle tube 13A of the first barrier assembly to the surface of wall 14B facing 14A. U-shaped brackets 16E and 16F are also used for attaching the handle tube 13A of the second barrier assembly to wall 14A. However, the tie rod cover 8B and sheet roll 18 end of the second barrier is attached to the corner surface of the second wall 14B using clips 74A and 74B. The clip attachment is more stable for a raised barrier than u-shaped brackets that only function to hold the sheet under tension.

With setup 30, a gap between the top of the handle tube frame and the wall 14B is formed. This gap may present a snagging hazard for children's articles of clothing such as shirt collars and necklaces that may get caught in the gap thus creating a choking hazard. This problem is mitigated by closing this gap.

Setup 60 is similar to setup 30, but it additionally comprises a first embodiment of a snag shield 25. Snag shield 25 is a thin bent strip disposed between the top of the handle tube 13A and wall 14B. The front of the snag shield 25 is snapped onto the top of the handle tube 13A while the back of the snag shield 25 is screwed to the second wall 14B. The attachment of the snag shield 25 to second wall 14B is configured for repositioning the back strip of the snag shield 25 up or down the wall 14B which in turn moves the handle tube 13A closer or further away from the wall 14B. Setup 60 is presented in FIGS. 7 and 8.

In an embodiment of the present invention, the handle tube 13A contains a protrusion 92 extending from the bottom side of the handle tube 13A. This is shown in FIGS. 1, 6, 8 and 28. The protrusion is positioned below the level of the sheet 12 and functions to stop the handle and fabric roll at the proper point of retraction.

Figure 25:
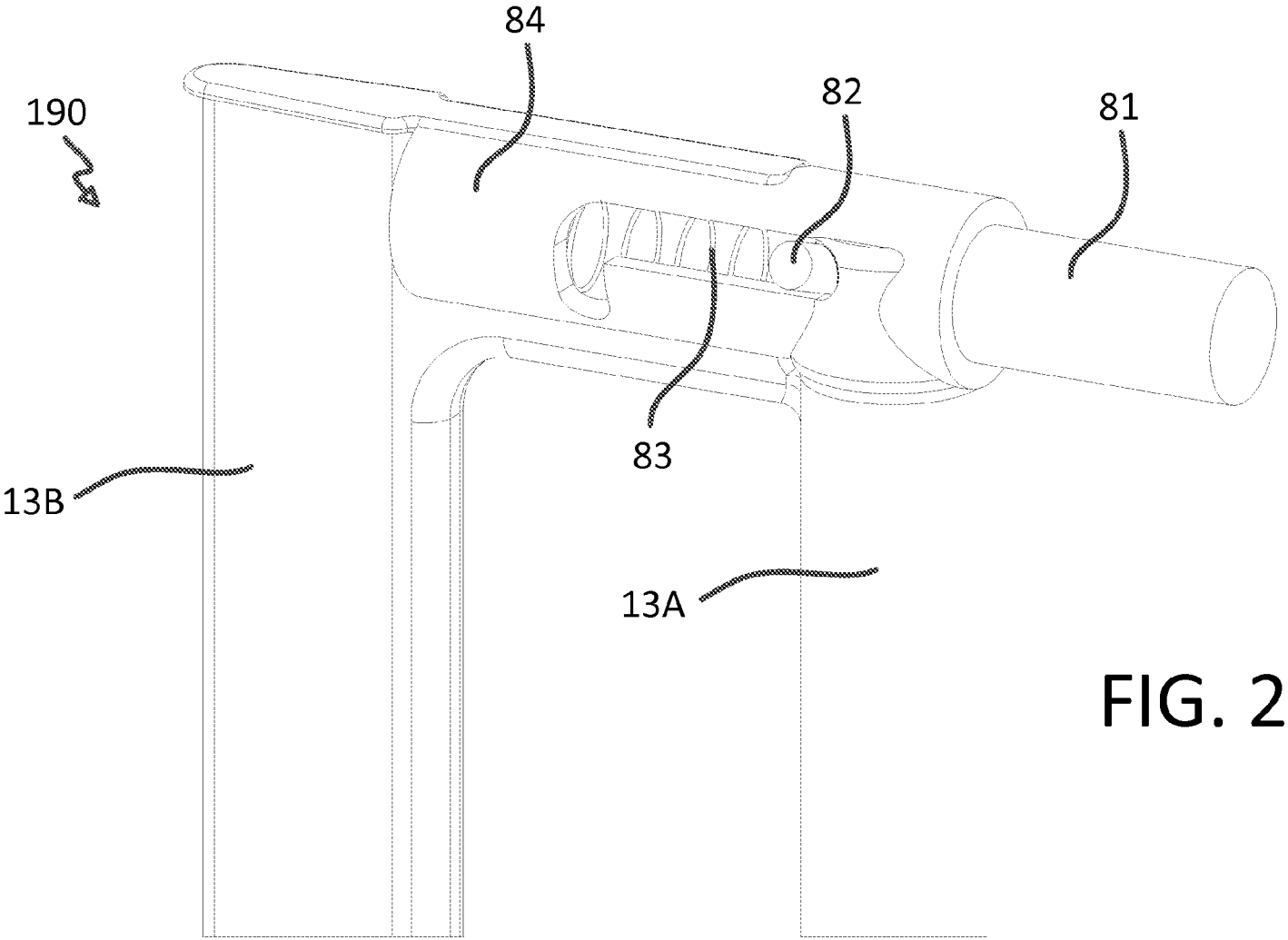
FIGS. 25 and 26 portray close-up views of a component of the first embodiment of an assembly for outstretching and retracting a barrier.
Figure 26:
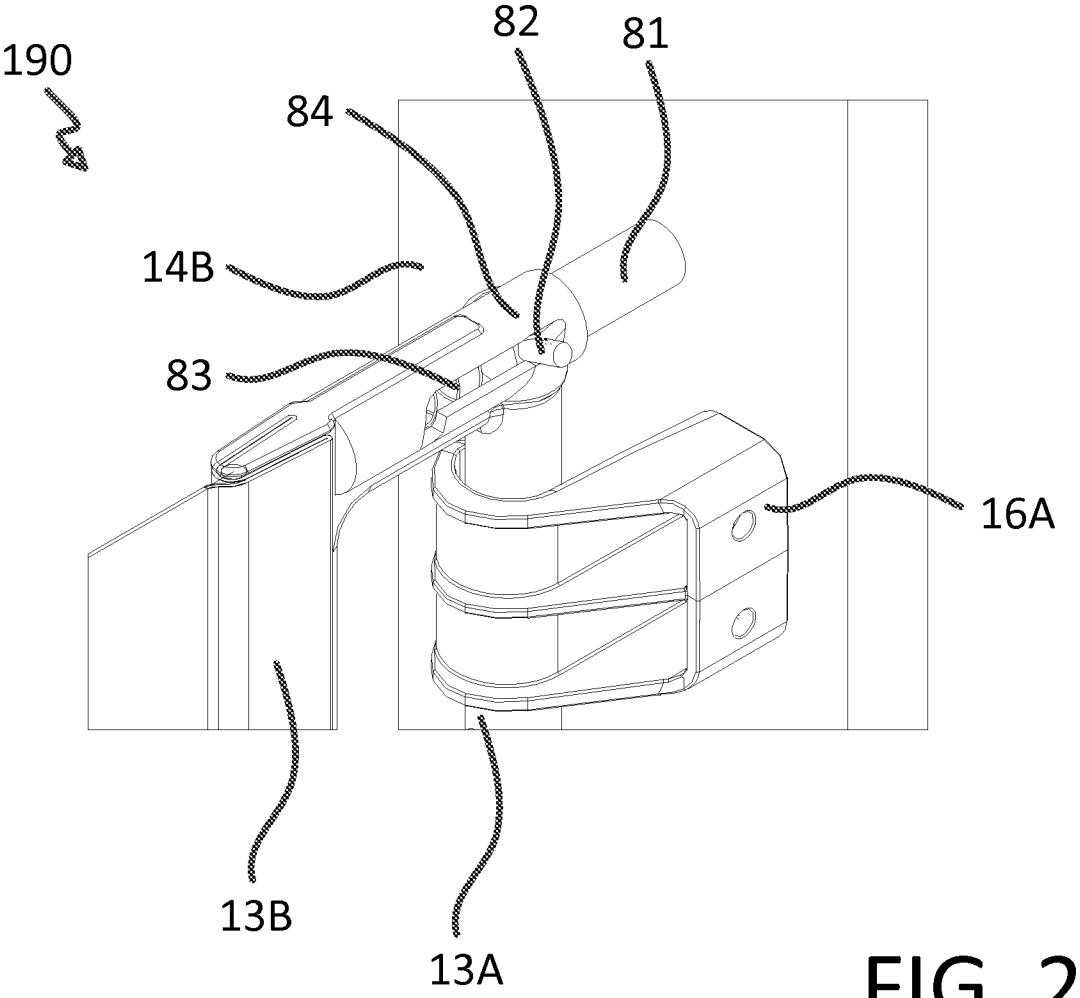
Figure 27:
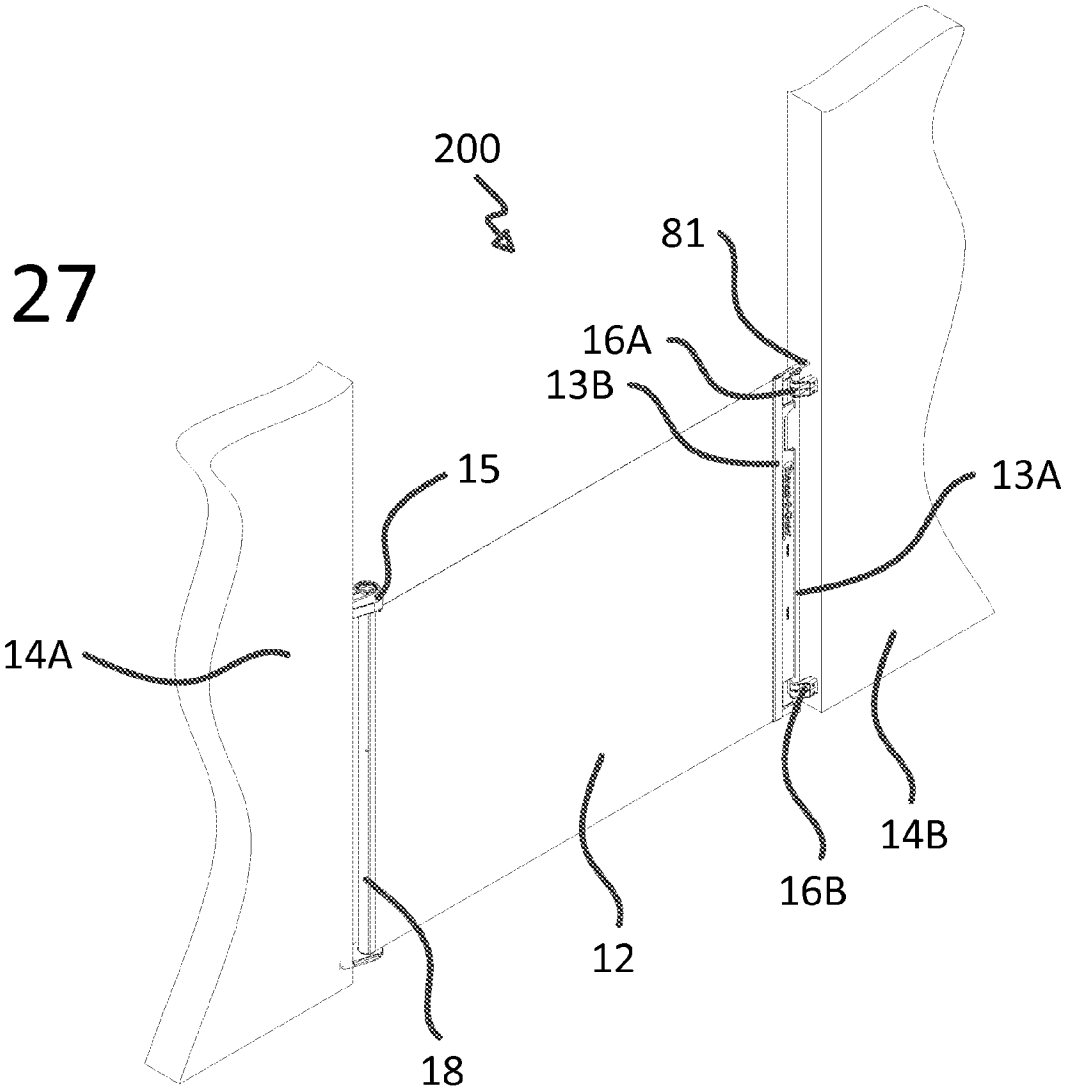
FIG. 27 is a perspective view of the first embodiment of an assembly for outstretching and retracting a barrier utilizing the component of FIGS. 25 and 26 in an eight use configuration.
Figure 28:
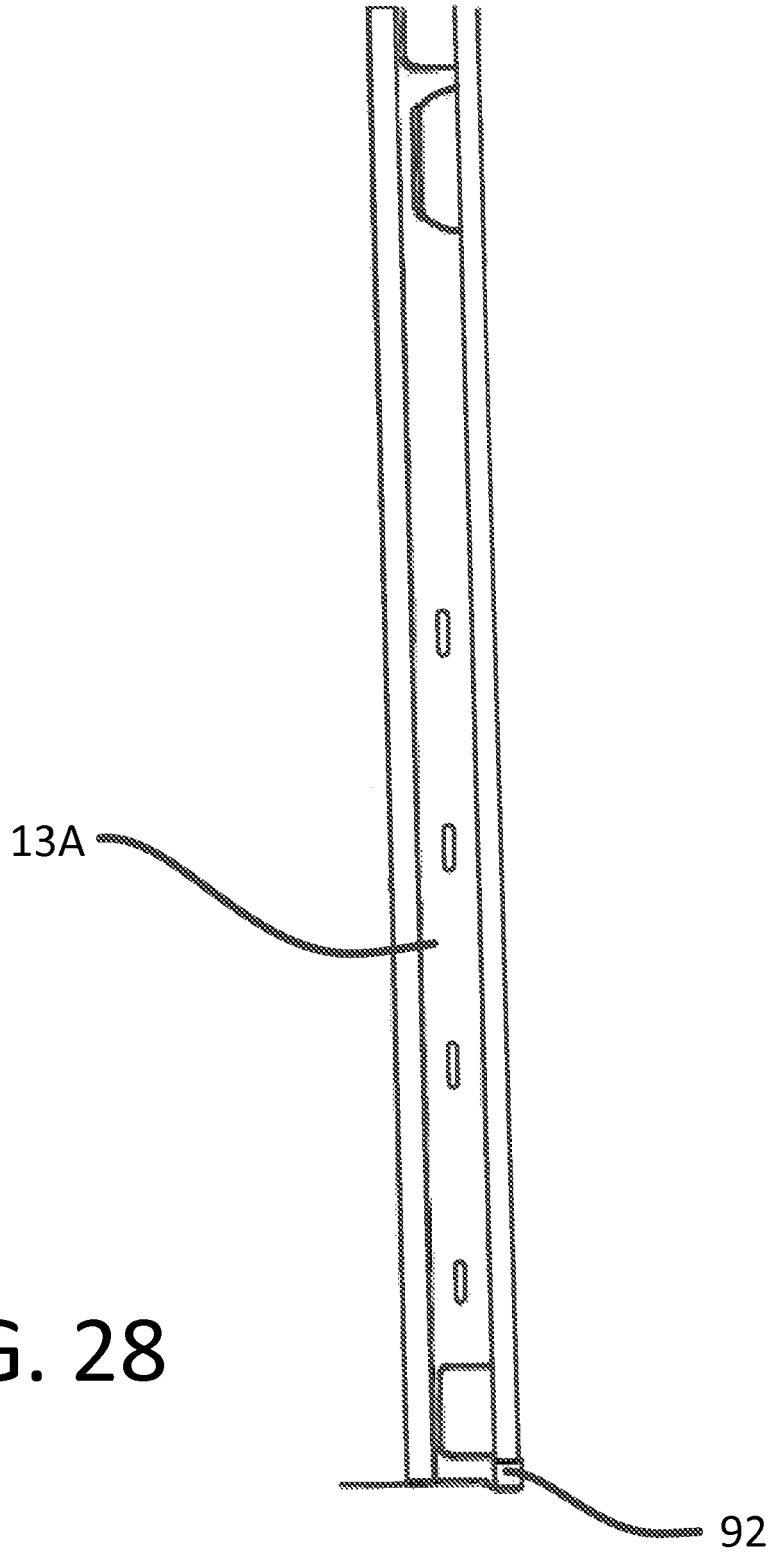
FIG. 28 is a front magnified view of a component of the first embodiment of an assembly for outstretching and retracting a barrier.

A second embodiment 190 of a snag shield 81 is shown in FIGS. 25 and 26. A cylindrical tongue 81 is encased inside a hollow upper housing 84 of the pullout frame that also includes handle tube 13A and attaching bar 13B. The cylindrical tongue 81 is spring loaded using spring 83. It may be held in a retracted position inside the upper housing 84 of the pullout frame or in a released position. Retracting the cylindrical tongue 81 is accomplished through pulling back on tab 82 and locking it in place. Releasing the tab 82 allows the spring 83 to push the cylindrical tongue 81 out of the upper housing 84 to cover the gap between upper housing 84 and wall 14B and acting as a snag shield. Setup 200 in FIG. 27 incorporates the second embodiment of the snag shield 190.

When a post 26 replaces one of the walls at the top of stairs 43, a stair post adaptor 27 may be used as an attaching medium in order to avoid drilling holes into the post 26 for the u-shaped brackets 16A and 16B. The mechanism 80 in FIG. 10 for attaching the handle tube 13A to the stair post adaptor 27 uses four straps 28 for fastening the stair post adaptor 27 to the side of the post 26 onto which the handle tube 13A is placed and uses two u-shaped brackets 16A and 16B for attaching the handle tube 13A to the stair post adaptor 27 by screws. The u-shaped brackets 16A and 16B then clamp onto handle tube 13A holding it under tension in setup configuration 70. Cap 29 covers the top of post adaptor 27.

In order to help prevent an animal or child from slipping under barrier sheet 12, a threshold barrier 32 is attached to the bottom of the sheet. For a relatively short barrier, a single threshold barrier 32 may be used, or multiple threshold barriers 32 attached to one another would be used as needed for longer sheets. In the configuration shown in FIG. 12, two threshold barriers 32A and 32B are attached to each other using couplers 31 attached to the ends of the threshold barriers 32A and 32B by screws. The bottom side of the sheet 12 is disposed inside a slot in the threshold barrier 32 that is placed on the ground as illustrated by configuration 90. The sheet is configured to slide freely inside the slot. It is noted that the strips 47 of the threshold barriers 32A and 32B into which the screws are inserted for attaching the couplers 31 are thicker than the opposing strip which does not contain a screw.

In setup 100, two barrier assemblies are attached front to back to form a two sheet barrier 12A and 12B. This configuration allows attaching multiple barrier assemblies to fence off larger spans than a single barrier assembly configuration 30 would be capable of. The first assembly, shown with tie rod sleeve 8A, locking assembly upper housing member 15A, lower housing member 19A, sheet 12A, base housing 24A, handle tube 13A1, sheet attaching bar 13B1 and handle grip 11A, is attached to wall 14A using u-shaped brackets 16A1 and 16B1.

The tie rod sleeve 8B of the second barrier assembly is attached to handle tube 13A1 of the first assembly using straps 33A and 33B. The second barrier assembly in setup 100, shown with locking assembly upper housing member 15B, lower housing member 19B, sheet 12B, base housing 24B, handle tube 13A2, sheet attaching bar 13B2 and handle grip 11A, is attached to wall 14B using u-shaped brackets 16A2 and 16B2. With this configuration, the handle tube 13A2 of the second barrier assembly is held by u-shaped brackets 16A2 and 16B2 attached to wall 14B by screws. It is noted that additional barrier assemblies may be added between the second barrier and wall 14B in the same manner as the second barrier assembly is strung onto the first barrier assembly.

Barrier assembly 110 shown in FIGS. 14 and 15 is similar to barrier assembly 10 except for the locking assembly being absent. The upper housing member 34 does not have the lock and unlock settings or the knob placement groove. Also not included are the compression spring and the gear wheel.

In setup 120, barrier assembly 110 is attached to a wall 14A at the sheet 12 unwinding end and to a side of the door 36 at the leading front. The attachments are accomplished by means of two u-shaped brackets 16A1 and 16B1 for attaching to the wall 14A, and 16A2 and 16B2 for attaching to the door 36 attachment. Setup 120 is used to create a barrier 12 when opening a door, a front door of a house, for example; the barrier would then prevent a dog or a cat from running out the house. Opening the door 36 would pull out sheet 12 to block the opening to prevent a dog from running out. This places the barrier sheet 12 under tension as a result of the pull force exerted by the torsion spring roll 2. Having a locking assembly is undesirable for this setup, as opening the door 36 when the setting is left inadvertently in the lock position pries against the locking assembly and can damage the assembly.

A barrier assembly 130 used primarily for, though not limited to, the outdoors is shown in the retracted configuration in FIG. 17 and in the exploded configurations shown in FIGS. 18 and 19. The setup configurations for barrier assembly 130 are presented in FIGS. 20-24. In general, the sheets used in these setups cover much longer spans than barrier assembly 10.

As with the barrier assembly 10, barrier assembly 130 is structured using a handle tube frame having a handle tube 46B and fabric attaching bar 46A, a handle grip 11 configured to snap onto the handle tube 46B, loop 35A and spline 35B inserted into attaching bar 46A for attaching sheet 12 to the attaching bar 46A and an upper cap knob 45A for covering openings in the upper portion of handle tube 46B and attaching bar 46A while a lower cap knob 45B covers openings in the lower portion of handle tube 46B and attaching bar 46A. As with barrier assembly 10, reel tube 9 is placed inside sheet roll 18. Barrier assembly 130 includes the locking assembly 20 of barrier assembly 10. The locking assembly 20 when used in conjunction with barrier assembly 130 is configured to prevent the sheet 12 from inadvertently snapping back while under tension.

Barrier assembly 130 includes a first ground receiver 38A and a second ground receiver 38B that are configured for ground anchoring to provide balance and stability to the barrier structure in an outdoor environment. The first ground receiver 38A is attached to the bottom of the handle tube 46B via adaptor rod 39A while the second ground receiver 38B is attached to the bottom of the reel tube 9 via adaptor rod 39B. It is noted that the attachment of adaptor rod 39B to reel tube 9 requires adaptor rod 39B to be threaded through opening 54 in the base housing 44. Adaptor rod 39B fits into reel tube 9 as a tight sleeve. It is also noted that the attaching bar 46A of barrier assembly 130 has a larger diameter than the attaching bar 13B component of barrier assembly 10 in order to accommodate adaptor rod 39A.

There are other major differences between barrier assembly 130 and barrier assembly 10. The torsion spring roll is absent from barrier assembly 130 as a torsion spring roll would be ineffective for applying tension onto sheets that are significantly longer than 25 feet. The sheet roll 18 has a significantly longer sheet 12 wound onto it and thus the center opening is smaller. The base housing 44 of the assembly structure 130 has an opening 54 at the front side instead of vertical extension 52. The reel tube 9 is placed inside the sheet roll 18 and is lodged inside opening 54 in the base housing 44 to hold it in place. The attachment of adaptor rod 39B for ground receiver 38B goes through opening 54 in the base housing 44. As with barrier assembly 10, the tie rod 7 and protective sleeve 8 are placed at the rear of the assembly to slip onto rear vertical extension 53.

In lieu of a torsion spring roll, applying tension onto barrier sheet 12 with barrier assembly 130 is accomplished using hand crank 37. Drive member 58 is adapted to fit snugly into slot 51 of reel tube 9. The bottom end of the vertical arm of the crank 37 traverses through the openings in locking assembly 20 and is inserted inside an opening in the drive member 58. Turning the crank 37 clockwise engages drive member 58 which in turn engages reel tube 9 causing it to turn clockwise to wind sheet 12 into roll 18.

Turning the hand crank 37 clockwise while the sheet 12 is pulled out and the handle tube 46A is anchored by the first ground receiver 38A applies a tension force onto the sheet 12. The tension on sheet 12 may then be set by engaging locking assembly 20 which keeps the sheet taut. Unlocking the sheet enables the hand crank 37 to wind the sheet 12 as needed.

Barrier assembly 130 may be used indoors as illustrated by setup 140 in which the sheet 12 is spread between walls 14A and 14B.

In setup 150, two barrier assembles having sheets 12A and 12B respectively are attached front to front, with the first assembly being supported by ground receiver 38A1 and 38B1, while the second assembly is supported by ground receiver 38A2 and 38B2. Since sheets 12A and 12B are placed under tension in normal use, they must be attached to each other to prevent them from retracting. This attachment is accomplished by clips 41A and 41B that tie the two handle tubes 46B1 and 46B2 together. In this manner setup 150 is configured to fence off large spans in an outdoor environment.

In setup 160, stakes 42 adapted for ground anchoring are used to supplement the support for this outdoor barrier 12. Two stakes 42 are used to support the base housing 44 and the locking assembly housing end 15, and two stakes 42 are used to support the attaching bar 46A and handle tube 46B end. The stakes 42 supporting the end containing base housing 44 and locking assembly housing 15 are attached using cord 71 that threads through a junction between middle housing 19 and tie rod sleeve 8. The stakes 42 supporting the end containing the attaching bar 46A and handle tube 46B are wrapped through an opening in the frame formed by attaching bar 46A and handle tube 46B using cord 73.

Setup 170 covers a relatively short outdoor span using only ground receivers 38A and 38B that are pounded into the ground so stake supports 42 are not needed. To use setup 170 indoors without ground receivers 38A and 38B, a mandrel 59 having vertical extension 52 is placed under base housing 44 as shown in setup 180. Vertical extension 52 fits into opening 54 in base housing 44. The mandrel 59 keeps the bottom of the sheet roll 18 from coming off base housing 44. In setup 170, ground receiver 38B performed this function, but ground receivers are not used indoors. Though not shown, each end of the barrier in this setup is configured for attaching to a corresponding wall as in setup 140.

It should be understood, of course, that the foregoing relates to exemplary embodiments of the invention and that modifications may be made without departing from the spirit and scope of the invention.

I claim:

1. A first barrier assembly comprising:

a sheet wound into a sheet roll having a hollow center to form a retracted configuration, said sheet being configured for unwinding from the sheet roll to form an outstretched barrier, said sheet having a leading edge;

a pullout frame having a handle tube and an attaching bar, said leading edge of the sheet being attached to an attaching bar;

a base housing adapted for placement onto a ground surface, said base housing containing a rear vertical extension and a front vertical extension;

a tie rod having a hollow center, a top opening and a bottom opening, said bottom opening being adapted for placement onto the rear vertical extension of the base housing;

a reel tube adapted to fit inside the sheet roll, said reel tube being adapted to slide over the front vertical extension of the base frame;

a torsion spring roll adapted to tightly fit inside the reel tube; said torsion spring roll being adapted for applying tension onto the outstretched barrier; and a locking assembly attached to the top of the sheet roll and the top of the tie rod, said locking assembly comprising:

an upper housing member;

a middle housing member having a bottom opening and a plurality of teeth;

a compression spring placed inside the middle housing member;

a gear member having a center opening and a plurality of teeth, said gear member being placed inside the middle housing member over the compression spring; and a knob adapted for placement onto a top side of the upper housing member, said knob being configured for switching between a lock position and an unlock position, wherein, in the lock position, the knob applies a downward pressure on the gear, said upper housing member and middle housing member combining to form an enclosure, said gear member and said compression spring being contained inside said enclosure, said enclosure being placed onto the top of the sheet roll and the top of the reel tube such that the gear member is engaged with a slot disposed at the top of the reel tube, and such that in the lock position the gear locks the barrier assembly and prevents movement of the sheet and, in the unlock position, sheet movement is unrestrained.

2. The barrier assembly of claim 1 further comprising a handle grip attached to the handle tube, said handle grip being adapted to swivel about 30 degrees to each side of the handle tube.

3. The barrier assembly of claim 2 further comprising a protective sleeve adapted to slide over the tie rod.

4. The barrier assembly of claim 3 further comprising an upper cap knob adapted for covering openings in an upper portion of the handle tube and the attaching bar, said barrier assembly of claim 1 further comprising a lower cap knob adapted for covering openings in a lower portion of the handle tube and the attaching bar.

5. The barrier assembly of claim 4 wherein the tie rod is attached to a first wall wherein attaching the tie rod to the first wall is accomplished by at least one u-shaped bracket attached to the first wall, said u-shaped bracket having a curved arm for holding the tie rod.

6. The barrier assembly of claim 5 wherein the handle tube is attached to a second wall with the barrier being outstretched and under tension, said second wall being disposed at a predetermined distance from the first wall, and wherein attaching the handle tube to the second wall is accomplished by at least one u-shaped bracket attached to the second wall, said u-shaped bracket having a curved arm for holding the handle tube.

7. The barrier assembly of claim 5 further comprising:

a second barrier assembly comprising a sheet wound into a sheet roll having a hollow center to form a retracted configuration, said sheet being configured for unwinding from the sheet roll to form an outstretched barrier, said sheet having a leading edge; a pullout frame having a handle tube and an attaching bar, said leading edge of the sheet being attached to the attaching bar; a base frame having a base housing adapted for placement onto a ground surface, said base housing containing a rear vertical extension and a front vertical extension; a tie rod having a hollow center and having a top opening and a bottom opening, said bottom opening being adapted for placement onto the rear vertical extension of the base housing; a reel tube adapted to tightly fit inside the sheet roll, said reel tube being adapted to slip onto the front vertical extension of the base frame; a torsion spring adapted to tightly fit inside the reel tube; said torsion spring being adapted for applying tension onto the outstretched barrier; and a locking assembly attached to the top of the sheet roll and the top of the tie rod, wherein the tie rod of the second barrier assembly is attached to a second wall wherein attaching the tie rod to the second wall is accomplished by at least one u-shaped bracket attached to the second wall, said u-shaped bracket having a curved arm for holding the tie rod, wherein, in the outstretched form of the first barrier assembly and the outstretched form of the second barrier assembly, the handle tube of the first barrier assembly and the handle tube of the second barrier assembly are disposed adjacent to one another and are attached to one another by at least one hook.

8. The barrier assembly of claim 6 further comprising a third barrier assembly comprising a sheet wound into a sheet roll having a hollow center to form a retracted configuration, said sheet being configured for unwinding from the sheet roll to form an outstretched barrier, said sheet having a leading edge; a pullout frame having a handle tube and an attaching bar, said leading edge of the sheet being attached to the attaching bar; a base frame having a base housing adapted for placement onto a ground surface, said base housing containing a rear vertical extension and a front vertical extension; a tie rod having a hollow center and having a top opening and a bottom opening, said bottom opening being adapted for placement onto the rear vertical extension of the base housing; a reel tube adapted to tightly fit inside the sheet roll, said reel tube being adapted to slip onto the front vertical extension of the base frame; a torsion spring adapted to tightly fit inside the reel tube; said torsion spring being adapted for applying tension onto the outstretched barrier; and a locking assembly attached to the top of the sheet roll and the top of the tie rod, the tie rod of the third barrier assembly being attached to the second wall above the first barrier assembly wherein attaching the tie rod of the third assembly to the second wall is accomplished by at least one clip attached to the second wall, the handle tube of the third assembly being attached to the first wall above the first barrier assembly with the barrier in an outstretched form, and wherein attaching the handle tube of the third assembly to the first wall is accomplished by at least one u-shaped bracket attached to the first wall, said u-shaped bracket having a curved arm for holding the handle tube.

9. The barrier assembly of claim 6, further comprising a snag shield having a bottom strip portion and a curving upper strip portion, said bottom strip being attached to a top of the handle tube the upper strip is attached to the second wall.

10. The barrier assembly of claim 5 wherein the handle tube is attached to a stair post adaptor, said stair post adaptor being attached to a stair post by at least one strap, said stair post being disposed at a predetermined distance from the first wall, and wherein attaching the handle tube to the stair post adaptor with the barrier being outstretched is accomplished by at least one u-shaped bracket attached to the stair post adaptor, said u-shaped bracket having a curved arm for holding the handle tube.

11. The barrier assembly of claim 6 further comprising at least one threshold barrier strip having a slot, said threshold barrier strip being disposed under the sheet, wherein a bottom of the sheet is inserted into the threshold barrier slot and wherein a second threshold barrier is attached to a first threshold barrier by a coupler.

12. The barrier assembly of claim 5 further comprising:

a fourth barrier assembly comprising a sheet wound into a sheet roll having a hollow center to form a retracted configuration, said sheet being configured for unwinding from the sheet roll to form an outstretched barrier, said sheet having a leading edge; a pullout frame having a handle tube and an attaching bar, said leading edge of the sheet being attached to the attaching bar; a base frame having a base housing adapted for placement onto a ground surface, said base housing containing a rear vertical extension and a front vertical extension; a tie rod having a hollow center and having a top opening and a bottom opening, said bottom opening being adapted for placement onto the rear vertical extension of the base housing; a reel tube adapted to tightly fit inside the sheet roll, said reel tube being adapted to slip onto the front vertical extension of the base frame; a torsion spring adapted to tightly fit inside the reel tube; said torsion spring being adapted for applying tension onto the outstretched barrier; and a locking assembly attached to the top of the sheet roll and the top of the tie rod, wherein the handle tube of the fourth barrier assembly is attached to a second wall wherein attaching the handle tube to the second wall is accomplished by at least one u-shaped bracket attached to the second wall, said u-shaped bracket having a curved arm for holding the handle tube of the fourth barrier assembly, wherein, in the outstretched form of the first barrier assembly and in the outstretched form of the second barrier assembly, the handle tube of the first barrier assembly and the tie rod of the fourth barrier assembly are disposed adjacent to one another and are attached to one another by at least one strap.

13. A fifth barrier assembly comprising:

a sheet wound into a sheet roll having a hollow center to form a retracted configuration, said sheet being configured for unwinding from the sheet roll to form an outstretched barrier, said sheet having a leading edge;

a pullout frame having a handle tube and an attaching bar, said leading edge of the sheet being attached to the attaching bar;

a base frame having a base housing adapted for placement onto a ground surface, said base housing containing a rear vertical extension and a front vertical extension;

a tie rod having a hollow center and having a top opening and a bottom opening, said bottom opening being adapted for placement onto the rear vertical extension of the base housing, wherein the tie rod of the fifth barrier assembly is attached to a first wall, wherein attaching the tie rod of the fifth barrier assembly to the first wall is accomplished by at least one u-shaped bracket attached to the first wall, said u-shaped bracket having a curved arm for clasping the tie rod of the fifth barrier assembly; wherein the handle tube of the fifth barrier assembly is attached to a side of a door, said side of the door being adjacent to the first wall in a closed position of said door, wherein attaching the handle tube of the fifth barrier assembly to the door is accomplished by at least one u-shaped bracket attached to the side of the door said u-shaped bracket attached to the side of the door having a curved arm for clasping the handle tube of the fifth barrier assembly, and wherein opening the door results in outstretching the sheet under tension and wherein closing the door results in the retraction of the sheet;

a reel tube adapted to tightly fit inside the sheet roll, said reel tube being adapted to slip onto the front vertical extension of the base frame;

a torsion spring adapted to tightly fit inside the reel tube; said torsion spring being adapted for applying tension onto the outstretched barrier; and a housing assembly attached to the top of the sheet roll and the top of the tie rod.

14. A sixth barrier assembly comprising:

a sheet wound into a sheet roll having a hollow center to form a retracted configuration, said sheet being configured for unwinding from the sheet roll to form an outstretched barrier, said sheet having a leading edge;

a pullout frame having a handle tube and an attaching bar, said leading edge of the sheet being attached to the attaching bar;

a base frame having a base housing adapted for placement onto a ground surface, said base housing containing a rear vertical extension and a front round opening;

a tie rod having a hollow center and having a top opening and a bottom opening, said bottom opening being adapted for placement onto the rear vertical extension of the base housing;

a reel tube adapted to fit inside the sheet roll, and a bottom of the reel tube being adapted to slip through the front round opening in the base frame; and a locking assembly attached to the top of the sheet roll and the top of the tie rod, said locking assembly comprises:

an upper housing member;

a middle housing member having a bottom opening and a plurality of teeth;

a compression spring placed inside the middle housing member;

a gear member having a center opening and a plurality of teeth, said gear member being placed inside the middle housing member over the compression spring; and a knob adapted for placement onto a top side of the upper housing member, said knob being configured for switching between a lock position and an unlock position, said upper housing member and middle housing member combining to form an enclosure, said gear member and said compression spring being contained inside said enclosure, said enclosure being placed onto the top of the sheet roll and the top of the reel tube such that the gear member is engaged with a slot disposed at the top of the reel tube, and such that in the lock position the gear locks the barrier assembly and prevents movement of the sheet and, in the unlock position, sheet movement is unrestrained.

15. The barrier assembly of claim 14 further comprising a hand crank configured for rewinding the outstretched barrier sheet into the roll, said barrier assembly also comprising a drive member adapted to fit in the slot disposed at the top of the reel tube, wherein a vertical arm of the drive member is configured for engagement with said drive member such that turning the crank clockwise results in turning the reel tube and sheet roll.

16. The barrier assembly of claim 15 further comprising a first ground receiver having a bottom portion adapted for ground insertion and a second ground receiver having a bottom portion adapted for ground insertion, wherein a top portion of the first ground receiver is attached to a bottom of the attaching bar of the sixth barrier assembly, and wherein a top portion of the second ground receiver is attached to a bottom of the reel tube of the sixth barrier assembly via an adaptor rod.

17. The barrier assembly of claim 15 wherein the tie rod is attached to a first wall wherein attaching the tie rod to the first wall is accomplished by at least one u-shaped bracket attached to the first wall, said u-shaped bracket having a curved arm for holding the tie rod and wherein the handle tube is attached to a second wall with the barrier being outstretched, said second wall being disposed at a predetermined distance from the first wall, wherein attaching the handle tube to the second wall is accomplished by at least one u-shaped bracket attached to the second wall, said u-shaped bracket having a curved arm for holding the handle tube, and wherein turning the crank clockwise and engaging the locking assembly places the sheet under tension.

18. The barrier assembly of claim 17 further comprising a mandrel having a front vertical extension, said base housing insert being placed under the base housing of the sixth barrier assembly in such a manner that the front vertical extension of the mandrel inserts into the opening in the base housing of the sixth barrier assembly.

19. The barrier assembly of claim 16, wherein the barrier sheet being outstretched, turning the crank clockwise and engaging the locking assembly places the sheet under tension.

20. The barrier assembly of claim 15, wherein the barrier sheet being outstretched, further comprising a first cord threaded through a junction between the middle housing and the tie rod, said first cord being tied at one end to a first stake anchored in the ground and tied at another end to a second stake anchored in the ground for further support, and further comprising a second cord that wraps through an opening in the pullout frame formed by attaching bar and the handle tube, said second cord being tied at one end to a third stake anchored in the ground and tied at another end to a fourth stake anchored in the ground for further support.

21. The barrier assembly of claim 19 further comprising a at least one clip wrapped around the handle tube of the barrier assembly, said clip being configured for attaching to the handle tube of another barrier assembly being positioned adjacent to the handle tube of the barrier assembly.

22. The barrier assembly of claim 6, further comprising a snag shield containing a tongue configured for encasing inside an upper housing of the pullout frame, said tongue also being configured for protruding outside the upper housing of the pullout frame in such a manner as to bridge a gap between the upper housing of the pullout frame and the second wall, said upper housing of the pullout frame also containing a spring member attached to an inner end of the cylindrical tongue, said spring member being configured for exerting an outward force onto the cylindrical tongue to maintain said cylindrical tongue in a protruded position, said spring member being configured for retraction and pulling back the cylindrical tongue.

23. The first barrier assembly of claim 1 further comprising a protrusion attached to a bottom side, an upper side or both the bottom and upper sides of the handle tube, said protrusion being positioned below a lower edge of the sheet and functions to prevent the handle from passing through the first barrier assembly.

* * * * *